US010373595B2

(12) United States Patent
Sato et al.

(10) Patent No.: US 10,373,595 B2
(45) Date of Patent: Aug. 6, 2019

(54) MUSICAL SOUND GENERATION DEVICE

(71) Applicant: CASIO COMPUTER CO., LTD., Shibuya-ku, Tokyo (JP)

(72) Inventors: Hiroki Sato, Nishi-Tokyo (JP); Hajime Kawashima, Akishima (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/910,901

(22) Filed: Mar. 2, 2018

(65) Prior Publication Data

US 2018/0277073 A1 Sep. 27, 2018

(30) Foreign Application Priority Data

Mar. 23, 2017 (JP) ..... 2017-058041

(51) Int. Cl.
*G10H 1/00* (2006.01)
*G10H 1/24* (2006.01)
(Continued)

(52) U.S. Cl.
CPC ..... *G10H 1/0008* (2013.01); *G10H 1/24* (2013.01); *G10H 1/32* (2013.01); *G10H 7/045* (2013.01);
(Continued)

(58) Field of Classification Search
CPC ..... G10H 1/0008; G10H 1/24; G10H 7/045
(Continued)

(56) References Cited

U.S. PATENT DOCUMENTS 4,429,367 A * 1/1984 Ikeda ..... G10L 13/00 704/267
4,508,001 A * 4/1985 Suzuki ..... G10H 7/02 84/604
(Continued)

FOREIGN PATENT DOCUMENTS

EP 2071560 A1 6/2009
JP 09026791 A 1/1997
(Continued)

OTHER PUBLICATIONS

Japanese Office Action dated May 21, 2018 (and English translation thereof) issued in counterpart Japanese Application No. 2017-058041.
(Continued)

*Primary Examiner* — David S Warren
(74) *Attorney, Agent, or Firm* — Holtz, Holtz & Volek PC

(57) ABSTRACT

A musical sound generation device including a first memory having a plurality of waveform data, a second memory which stores waveform data read out from the first memory, and a control processor which controls such that, when a sound emission instruction is provided and specified waveform data is in the second memory, the waveform data is read out by the sound source processor, or controls such that, when a sound emission instruction is provided and specified waveform data is not in the second memory, the specified waveform data is transferred from the first memory to the second memory and read out by the sound source processor, in which the control processor controls such that waveform data satisfying a set condition is not subjected to a waveform data change by the transfer and waveform data not satisfying the set condition is subjected to the waveform data change by the transfer.

14 Claims, 20 Drawing Sheets

(51) Int. Cl.
*G10H 7/04* (2006.01)
*G10H 1/32* (2006.01)

(52) U.S. Cl.
CPC . *G10H 2230/031* (2013.01); *G10H 2240/161* (2013.01)

(58) Field of Classification Search
USPC ..... 84/604
See application file for complete search history.

(56) References Cited

U.S. PATENT DOCUMENTS

| | | | | |
|---|---|---|---|---|
| 4,773,294 | A | 9/1988 | Iizuka et al. | |
| 5,345,035 | A | 9/1994 | Yamada | |
| 5,442,126 | A | 8/1995 | Tokiharu | |
| 5,463,183 | A | 10/1995 | Konno | |
| 5,686,682 | A | 11/1997 | Ohshima et al. | |
| 5,714,703 | A | 2/1998 | Wachi et al. | |
| 5,714,704 | A | 2/1998 | Suzuki et al. | |
| 5,804,755 | A | 9/1998 | Furukawa | |
| 6,576,827 | B2 | 6/2003 | Tamura | |
| 7,420,115 | B2 | 9/2008 | Kawamoto et al. | |
| 8,008,569 | B2 * | 8/2011 | Iwase | G10H 1/14 84/604 |
| 8,035,021 | B2 * | 10/2011 | Shirahama | G10H 1/183 84/605 |
| 9,922,633 | B2 * | 3/2018 | Sato | G10H 7/008 |
| 2002/0134222 | A1 | 9/2002 | Tamura | |
| 2006/0137515 | A1 | 6/2006 | Kawamoto et al. | |
| 2009/0151543 | A1 * | 6/2009 | Iwase | G10H 1/14 84/604 |
| 2010/0236384 | A1 * | 9/2010 | Shirahama | G10H 1/183 84/605 |
| 2011/0246188 | A1 | 10/2011 | Nakanishi | |
| 2014/0123835 | A1 | 5/2014 | Tsuchiya et al. | |
| 2015/0122110 | A1 * | 5/2015 | Nagasaka | G10H 7/02 84/604 |
| 2017/0278503 | A1 * | 9/2017 | Sato | G10H 7/008 |
| 2018/0277073 | A1 * | 9/2018 | Sato | G10H 1/24 |
| 2018/0277074 | A1 * | 9/2018 | Sato | G10H 1/0008 |
| 2019/0034115 | A1 * | 1/2019 | Sato | G06F 3/0604 |

FOREIGN PATENT DOCUMENTS

| | | | |
|---|---|---|---|
| JP | 09319373 | A | 12/1997 |
| JP | 11007281 | A | 1/1999 |
| JP | 2000276172 | A | 10/2000 |
| JP | 2007047293 | A | 2/2007 |
| JP | 2008015315 | A | 1/2008 |
| JP | 2008249756 | A | 10/2008 |
| JP | 2017054076 | A | 3/2017 |

OTHER PUBLICATIONS

Related U.S. Appl. No. 15/920,975, Title: "Musical Sound Generation Device," Filing Date: Mar. 14, 2018, First Named Inventor: Hiroki Sato.

Extended European Search Report (EESR) dated Jun. 8, 2018 issued in counterpart European Application No. 18160770.6.

Office Action (Non-Final Rejection) dated Mar. 21, 2019 issued in U.S. Appl. No. 15/920,975.

* cited by examiner

< TIMBRE WAVEFORM (VELOCITY KEY AREA WAVEFORM) SPLIT >

< TIMBRE WAVEFORM DIRECTORY >

| TIMBRE NUMBER | WAVEFORM NUMBER | MINIMUM VELOCITY | MAXIMUM VELOCITY | SMALLEST KEY NUMBER | LARGEST KEY NUMBER | ADDRESS FROM WAVEFORM AREA START | WAVEFORM SIZE |
|---|---|---|---|---|---|---|---|
| 0 | 0(1A) | 0 | 60 | 0 | 40 | 0000000H | 00BA00H |
| 0 | 1(2A) | 61 | 127 | 0 | 40 | 0000A00H | 00C100H |
| | | | | ⋮ | | | |
| | 10(5B) | 80 | 127 | 100 | 127 | 00F2000H | 013800H |
| | | | | ⋮ | | | |
| 0 | 31 (UNASSIGNED) | 0 | 0 | 0 | 0 | 00FA000H | 000000H |
| 1 | 0 | 0 | 50 | 0 | 20 | 00FA000H | 009200H |
| | | | | ⋮ | | | |
| 15 | 31 | 70 | 7F | 60 | 7F | 98000000 | 02C500H |

FIG. 6A

< STATIC WAVEFORM DIRECTORY >

| AREA | TIMBRE NUMBER | TIMBRE WAVEFORM NUMBER | START ADDRESS | WAVEFORM SIZE |
|---|---|---|---|---|
| STATIC WAVEFORM 1 | 0 | 4 | 00000000H | 18522H |
| STATIC WAVEFORM 2 | 0 | 8 | 00018522H | 122ACH |
| ⋮ | | | | |
| STATIC WAVEFORM N | 15 | 30 | 00AC122AH | 38A6EH |

FIG. 6B

< WAVEFORM READING DEVICE BUFFER DIRECTORY >

| BUFFER NUMBER | TRANSFER FLAG | TIMBRE NUMBER | TIMBRE WAVEFORM NUMBER | WAVEFORM SIZE |
|---|---|---|---|---|
| 1 | 1 | 0 | 8 | 8C50H |
| 2 | 1 | 0 | 12 | 8908H |
| 3 | 1 | 0 | 10 | 6384H |
| 4 | 1 | 0 | 11 | 7890H |
| 5 | 0 | 0 | 0 | 0 |
| ⋮ | | | | |
| 256 | 0 | 0 | 0 | 0 |

MUSICAL SOUND GENERATION DEVICE

CROSS-REFERENCE TO RELATED APPLICATION

This application is based upon and claims the benefit of priority from the prior Japanese Patent Application No. 2017-058041, filed Mar. 23, 2017, the entire contents of which are incorporated herein by reference.

BACKGROUND OF THE INVENTION

1. Field of the Invention

The present invention relates to a musical sound generation device, a musical sound generation method, a musical sound generation program and an electronic instrument.

2. Description of the Related Art

In electronic instruments and personal computers in recent years, musical sound generation methods using various sound source data (waveform data) have been adopted so as to actualize musical sounds having a higher degree of fidelity to the original sounds of wind instruments stringed instruments and the like. For example, some software sound source that is operated on an electronic instrument or personal computer adopts a system in which all pieces of waveform data that serve as sound sources are stored in a (low-speed, large-capacity) storage device with a low access speed and a large storage capacity such as a flash memory or hard disk, and only waveform data for use in sound emission is transferred from this low-speed, large-capacity storage device to a (high-speed, small-capacity) storage device with a high access speed and a small storage capacity and is read out in accordance with a musical performance for sound emission.

Here, generally speaking, high-speed small-capacity storage devices have high product prices, and low-speed, large-capacity storage devices have low product prices. For this reason, waveform data having a data size larger than the storage capacity of a high-speed, small-capacity storage device is retained in a low-speed, large-capacity storage device, and is moved to the high-speed, small-capacity storage device only when needed for use in sound emission, whereby both of a favorable waveform data reading operation and a reduction in production cost are achieved. An example of a sound source device adopting this system is described in Japanese Patent Application Laid-Open (Kokai) Publication No. 11-007281, in which a musical sound with a desired timbre is emitted by pieces of waveform data read out being synthesized.

SUMMARY OF THE INVENTION

In accordance with another aspect of the present invention, there is provided a musical sound generation device comprising: a first memory having a plurality of waveform data stored therein; a second memory which stores waveform data read out from the first memory in a manner that the waveform data is readable for sound emission by a sound source processor; and a control processor which controls such that, when an instruction for sound emission is provided and waveform data specified in association with the sound emission is in the second memory, the specified waveform data stored in the second memory is read out by the sound source processor, or controls such that, when an instruction for sound emission is provided and waveform data specified in association with the sound emission is not in the second memory, the specified waveform data is transferred from the first memory to the second memory and the transferred waveform data in the second memory is read out by the sound source processor, wherein the control processor controls such that, among a plurality of waveform data stored in the second memory, waveform data satisfying a set condition is not subjected to a waveform data change by the transfer, and waveform data not satisfying the set condition is subjected to the waveform data change by the transfer.

In accordance with another aspect of the present invention, there is provided a musical sound generation method, wherein a control processor of a musical sound generation device (i) causes waveform data read out from a first memory having a plurality of waveform data to be stored in a second memory in a manner to be readable for sound emission by a sound source processor, (ii) causes waveform data satisfying a set condition among the plurality of waveform data to be stored in the second memory in advance in a manner not to be changed by transfer, (iii) causes, when an instruction for sound emission is provided and specified waveform data is not in the second memory, the specified waveform data to be transferred from the first memory to the second memory and then causes the transferred waveform data in the second memory to be read out by the sound source processor, and (iv) controls such that, among a plurality of waveform data stored in the second memory, waveform data satisfying the set condition is not subjected to a waveform data change by the transfer, and waveform data not satisfying the set condition is subjected to the waveform data change by the transfer.

In accordance with another aspect of the present invention, there is provided a non-transitory computer-readable storage medium having stored thereon a program that is executable by a computer to function as the above-described musical sound generation device.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

FIG. 6A and FIG. 6B are diagrams for describing a static waveform area and a dynamic waveform area of the RAN applied in the present embodiment;

DETAILED DESCRIPTION OF THE PREFERRED EMBODIMENTS

Embodiments for implementing a musical sound generation device, a musical sound generation method, a musical sound generation program, and an electronic instrument according to the present invention will hereinafter be described in detail with reference to the drawings.

<Electronic Instrument>

Figure 1:
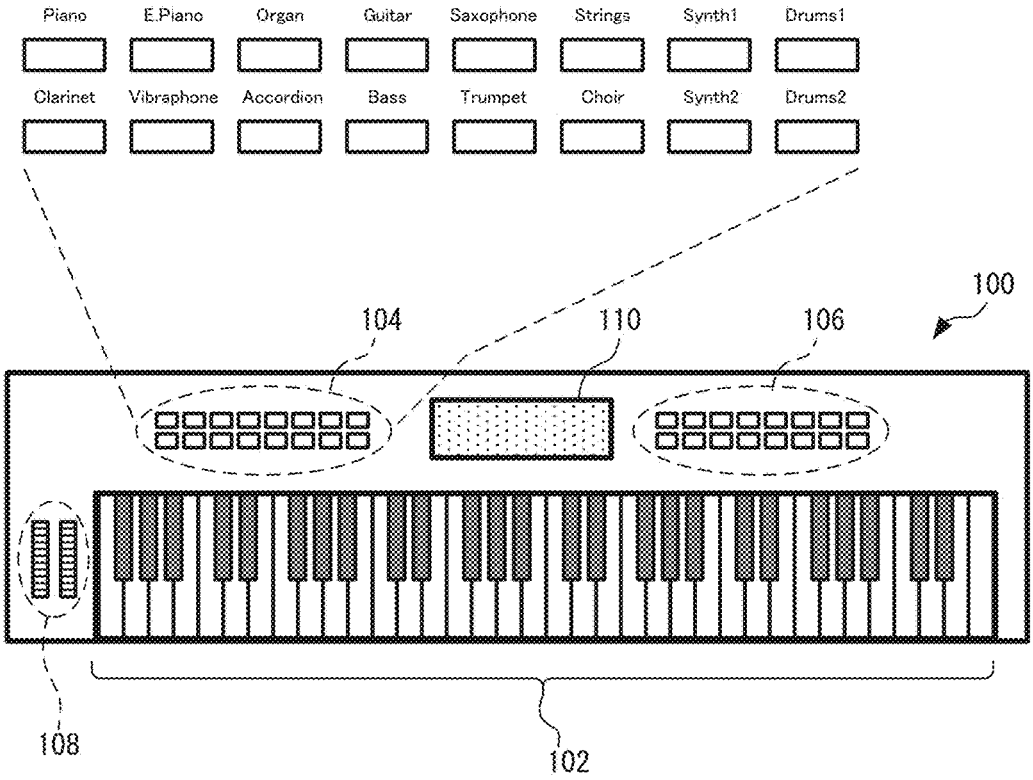
FIG. 1 is an external view of an embodiment of an electronic instrument where a musical sound generation device according to the present invention has been applied.

FIG. 1 is an external view of an embodiment of an electronic instrument where a musical sound generation device according to the present invention has been applied. Here, an electronic keyboard instrument of a waveform reading type is taken as an embodiment of the electronic instrument according to the present invention for description.

An electronic keyboard instrument 100 according to the present embodiment includes, on one surface side of its instrument main body, a keyboard 102 constituted by a plurality of keys that serve as musical performance operators, a switch panel constituted by timbre selection buttons 104 that serve as waveform selection operators for timbre selection and function selection buttons 106 for selection of various functions other than timbres, a bender/modulation wheel 108 for providing various modulations (musical performance effects) such as pitch bend, tremolo, and vibrato, and a display section such as an LCD (Liquid Crystal Display) 110 for displaying a timbre and other various setting information, as shown in FIG. 1. Although omitted in the drawing, the electronic keyboard instrument 100 includes a speaker for outputting musical sounds generated by a musical performance, on a bottom surface portion, side surface portion, back surface portion, or the like of the instrument main body.

In the above-structured electronic keyboard instrument 100, the timbre selection buttons 104 serve as waveform selection operators for selecting one of various timbre categories such as piano ("Piano" in the drawing), electric piano ("E. Piano" in the drawing), organ ("Organ" in the drawing), guitar ("Guitar" in the drawing), saxophone ("Saxophone" in the drawing), strings ("Strings" in the drawing), synthesizers ("Synth1" and "Synth2" in the drawing), and drums ("Drums1" and "Drums2" in the drawing) as shown in FIG. 1. In FIG. 1, sixteen timbre categories are shown. By depressing one of the timbre selection buttons 104, an instrument player (user) of the electronic keyboard instrument 100 can select and play any timbre category from among the above-described sixteen timbre categories.

Figure 2:
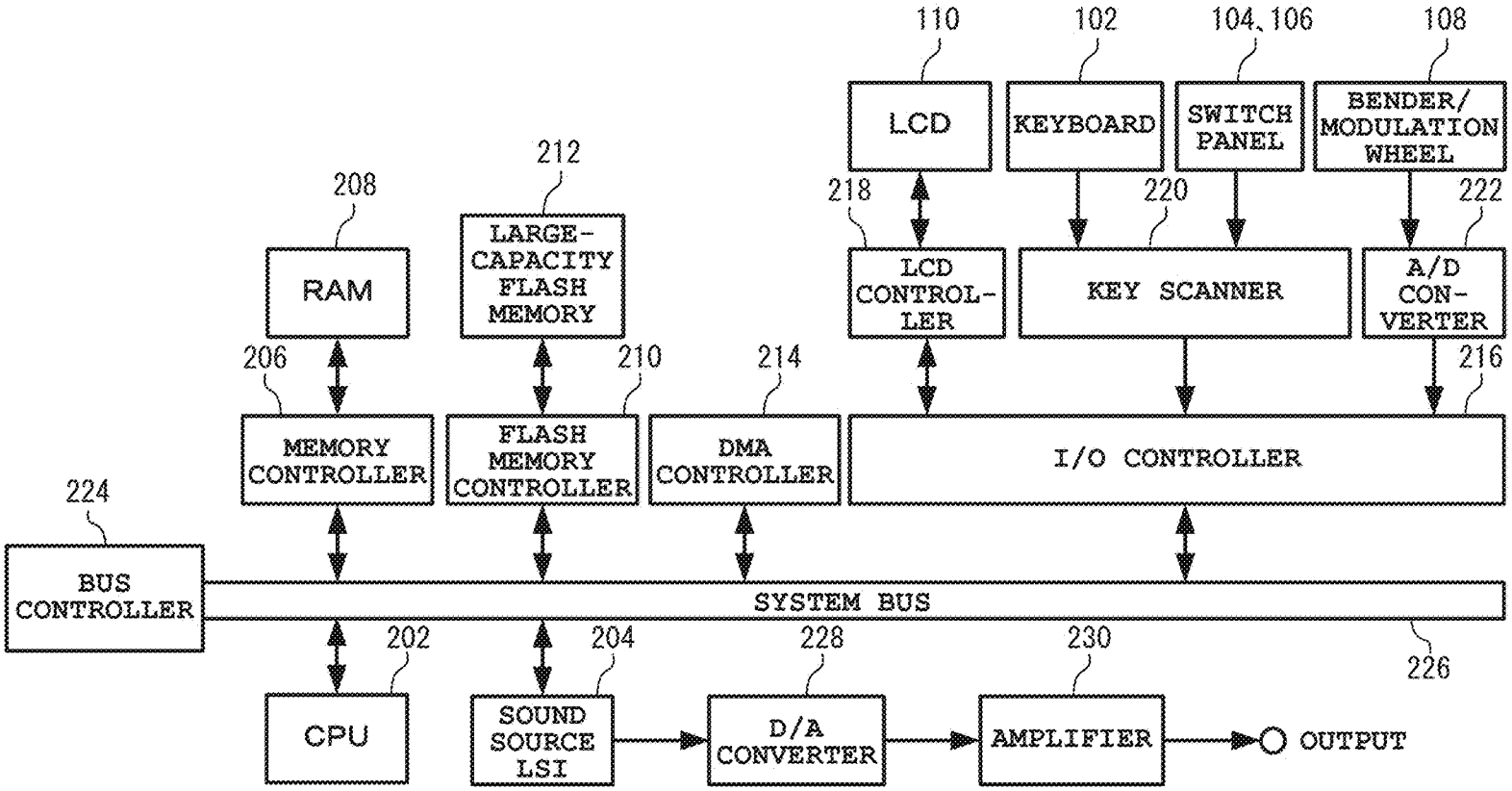
FIG. 2 is a block diagram showing an example of the hardware structure of the electronic keyboard instrument according to the present embodiment.
Figure 3:
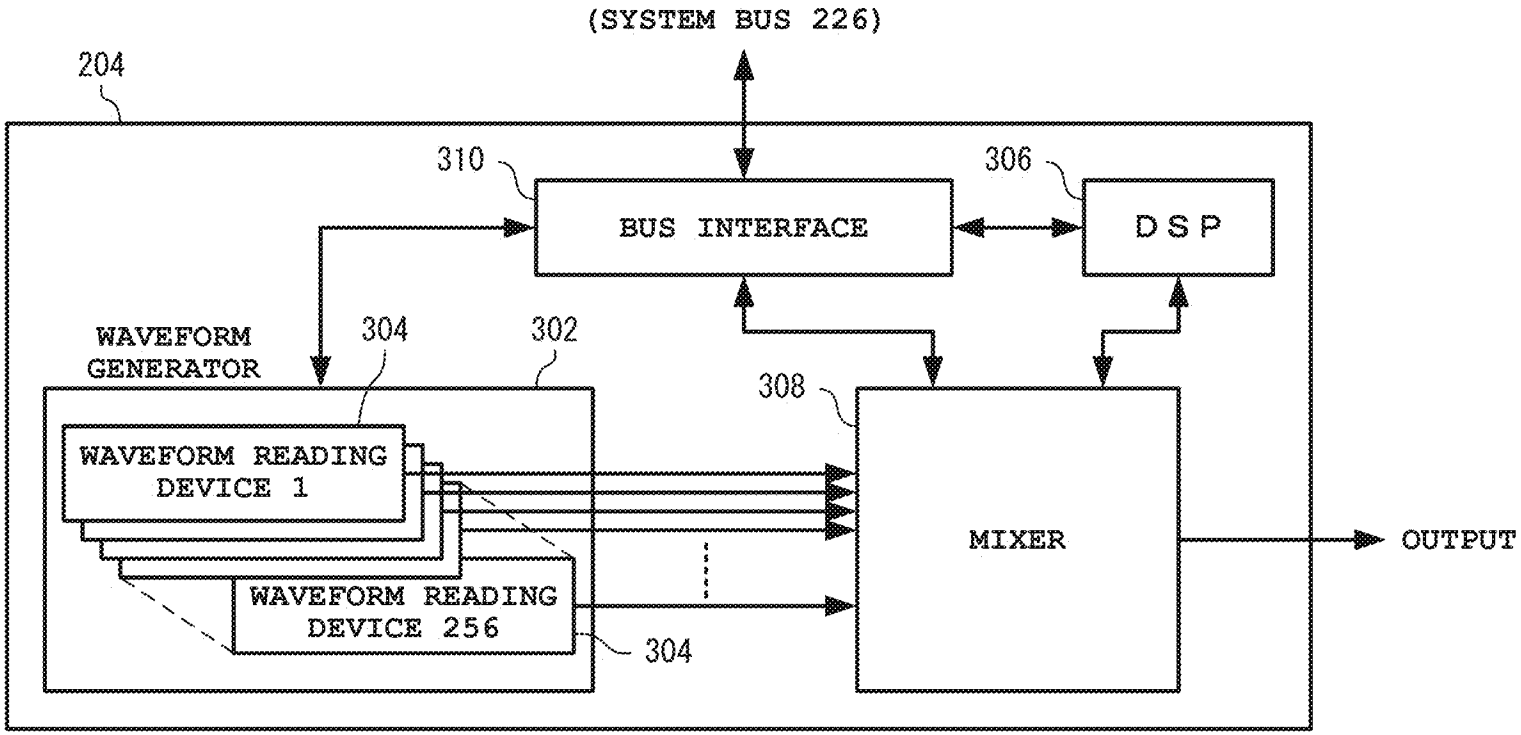
FIG. 3 is a block diagram showing an example of the internal structure of a sound source LSI applied in the present embodiment.

FIG. 2 is a block diagram showing an example of the hardware structure of the electronic keyboard instrument according to the present embodiment FIG. 3 is a block diagram showing an example of the internal structure of a sound source LSI applied in the present embodiment.

The electronic keyboard instrument 100 is structured to include, for example, a CPU (Central Processing Unit) 202, a sound source LSI (Large Scale Integration) 204, a DMA (Direct Memory Access) controller 214, and an I/O (input/output) controller 216, which are each directly connected to a system bus 226, as shown in FIG. 2. Also, the electronic keyboard instrument 100 is structured to include a small-capacity (second storage capacity) RAM (Random Access Memory) 206 with a high access speed (second reading speed) connected to the system bus 226 via a memory controller 206 and a large-capacity (first storage capacity) flash memory 212 with a low access speed (first read speed) connected thereto via a flash memory controller 210. Also, the electronic keyboard instrument 100 is structured to include the LCD 110 of FIG. 1 connected to the I/O controller 216 via an LCD controller 218, the keyboard 102 and the switch panel constituted by the timbre selection buttons 104 and the function selection buttons 106 of FIG. 1 which have been connected thereto via a key scanner 220, and the bender/modulation wheel 108 of FIG. 1 connected thereto via an A/D converter (analog-digital conversion circuit) 222. These sections are connected to the system bus 226 via the I/O controller 216. Also, the system bus 226 is connected to a bus controller 224, and signals and data transmitted and received among the above-described sections via the system bus 226 are controlled by the bus controller 224. Also, to the sound source LSI 204 (sound source processor), a D/A converter (digital-analog conversion circuit) 228 and an amplifier 230 are connected. Digital musical sound waveform data outputted from the sound source LSI 204 is converted by the D/A converter 228 to an analog musical sound waveform signal, amplified by the amplifier 230, and then outputted from an output terminal or the speaker omitted in the drawing. Here, at least the CPU 202, the sound source LSI 204, the RAM 208, and the large-capacity flash memory 212 constitute a musical sound generation device according to the present invention.

As described above, the entire electronic keyboard instrument 100 is structured with the system bus 226 that is controlled by the bus controller 224 as a centerpiece. Specifically, the bus controller 224 controls priorities of signals and data at the time of transmission and reception in each of the above-described sections connected to the system bus 226. For example, although the RAM 208 is structured to be shared by the CPU 202 and the sound source LSI 204 in the electronic keyboard instrument 100, since a data loss is not allowed in the sound source LSI 204, the highest priority is set by the bus controller 224 to transmission and reception between the sound source LSI 204 and the RAM 208, and an access to the RAM 208 by the CPU 202 is limited as required.

In the above-described structure, the CPU 202 is a main processor (control processor) that performs processing in the entire device, and performs a control operation on the electronic keyboard instrument 100 by executing a predetermined control program while using the RAM 208 as a work area.

The RAM 208 is a memory device whose access speed is high and capacity is low as compared to the large-capacity flash memory 212 described below, and is connected to the system bus 226 via the memory controller 206 serving as an interface. The RAM 208 has stored therein waveform data, a control program, various fixed data, and the like transferred from the large-capacity flash memory 212. In particular, the RAM 208 has a function to serve as a sound source memory (or a waveform memory) which develops waveform data for use in musical sound generation processing that is performed in the sound source LSI 204 described below, and the waveform data of a musical sound to be emitted is always arranged in the RAM 208. In addition, the RAM 208 is also used as a work area for the CPU 202 and a DSP (Digital Signal Processing circuit) 306 incorporated in the sound source LSI 204. Here, the storage capacity of the RAM 208 is smaller than that of the large capacity flash memory 212, and therefore storage contents in the RAM 208 are replaced one after another. However, waveform data satisfying a predetermined condition (having a data size exceeding a threshold value described further below) is fixedly stored with it being unchanged by waveform data transfer during a musical performance. The present embodiment is characterized by a management method regarding replacement of waveform data stored in the RAM 208, as will be described further below.

The large-capacity flash memory 212 is a large-capacity and inexpensive memory device with a low access speed such as that of an NAND type, and is connected to the system bus 226 via the flash memory controller 210 serving as an interface. The large-capacity flash memory 212 has stored therein various fixed data such as waveform data of all timbres, parameter data of all timbres, program data of control programs to be executed in the CPU 202 and the DSP 306 of the sound source LSI 204, music data, and data set by the instrument player, which will be used (or can be used) in musical sound generation processing in the sound source LSI 204. Here, all pieces of waveform data stored in the large-capacity flash memory 212 are compressed with, for example, one word length being set at eight bits. The waveform data and the like stored in the large-capacity flash memory 212 are read out by being sequentially accessed from the CPU 202 and transferred to the RAM 208.

In the present embodiment, the structure has been described in which an NAND-type flash memory (in practice, an SSD (Solid State Drive) structured by integrating a flash memory) is used as a large-capacity and inexpensive memory device. However, the present invention is not limited thereto. For example, as this large-capacity and inexpensive memory device, a hard disk (HDD) may be adopted. Also, the flash memory and the hard disk herein may be structured to be attachable to and detachable from (that is, replaceable in) the electronic keyboard instrument 100. Also, if high-speed data transfer is possible, a hard disk on a specific network or the Internet (that is, on a cloud) may be adopted as this large-capacity and inexpensive memory device.

The LCD controller 218 is an IC (Integrated Circuit) which controls the display status of the LCD 110. The key scanner 220 is an IC which scans the status of the keyboard 102 and the switch panel such as the timbre selection buttons 104 and the function selection buttons 106, and notifies the CPU 202 of the status. The A/D converter 222 is an IC which detects the operation position of the bender/modulation wheel 108. The LCD controller 218, the key scanner 220, and the A/D converter 222 input and output data and signals to and from the system bus 226 via the I/O controller 216 serving as an interface.

The sound source LSI 204 is a dedicated IC which performs musical sound generation processing described below. The above-described large-capacity flash memory 212 cannot be randomly accessed from the CPU 202 or the sound source LSI 204. For this reason, data and the like stored in the large-capacity flash memory 212 are once transferred to the randomly-accessible RAM 208. The sound source LSI 204 reads out, based on an instruction from the CPU 202, waveform data transferred to the RAM 208 from a target timbre storage area at a speed corresponding to a pitch specified by a musical performance, provides the read waveform data with an amplification envelope of a velocity specified by the musical performance, and outputs the resultant waveform data as output musical sound waveform data.

The sound source LSI 204 includes, for example, a waveform generator 302 having 256 waveform reading devices 304, the DSP 306, a mixer 308, and a bus interface 310 as shown in FIG. 3. The waveform generator 302, the DSP 306, and the mixer 308 are connected to the system bus 226 via the bus interface 310 for access to the RAM 208 and communication with the CPU 202. Each waveform reading device 304 of the waveform generator 302 is an oscillator which reads out waveform data from the RAM 208 and generates a timbre waveform. The DSP 306 is a signal processing circuit which provides an acoustic effect to an audio signal. The mixer 308 mixes signals from the waveform generator 302 and/or transmits and receives a signal to and from the DSP 306 so as to control the flow of an audio signal as a whole, and outputs the resultant signal to the outside. That is, the mixer 308 provides an envelope in accordance with a musical sound parameter supplied from the CPU 202 by the DSP 306 to waveform data read out from the RAM 208 by each waveform reading device 304 of the waveform generator 302 in accordance with a musical performance, and outputs the resultant data as output musical sound waveform data. An output signal from the mixer 308 is outputted via the D/A converter 228 and the amplifier 230 to a speaker, headphone, or the like omitted in the drawing as an analog signal at a predetermined signal level, as shown in FIG. 2.

(Waveform Data Management Method)

Here, waveform data stored in the above-described RAN and large-capacity flash memory is described in detail.

Figures 4A, 4B:
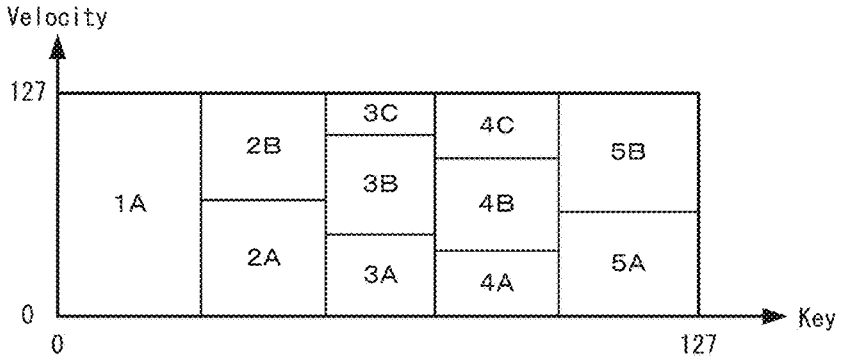
FIG. 4A and FIG. 4B are diagrams for describing a waveform data management method applied in the present embodiment.

FIG. 4A and FIG. 4B are diagrams for describing a waveform data management method applied in the present embodiment. FIG. 4A is a diagram for describing a timbre waveform split, and FIG. 4B is a diagram for describing a timbre waveform directory.

In the present embodiment, by the instrument player depressing a timbre selection button 104 provided to the electronic keyboard instrument 100, one of the sixteen types of timbres is selected for a musical performance. As a result timbre waveform data for each pitch or sound volume is read out from the large-capacity flash memory 212 to the RAM 208 in order to reproduce a change not only in sound volume and pitch but also in timbre based on a key area and/or velocity. Here, each timbre is constituted by, for example, thirty-two types of waveforms at maximum per timbre, and the waveform data thereof are stored in the large-capacity flash memory 212. As a method for managing waveform data for each pitch or sound volume for one timbre, a management method based on a timbre waveform split structure is applied in which waveform data is assigned for each key area ("Key" on the horizontal axis in the drawing) in which the instrument player performs a musical performance on the keyboard 102 and is also assigned for each velocity ("Velocity" on the vertical axis in the drawing) indicating a key depression speed (a strength in a musical performance) even in the same key area. That is, in the waveform data management method using a timbre waveform split structure, a sound area and a velocity area for one timbre are two-dimensionally split, and each split area is assigned with thirty-two waveforms at maximum. According to this management method, only one waveform is determined to be read out based on two factors including a velocity and a key number (key area) at the time of key depression.

Waveform data stored in the RAM 208 and the large-capacity flash memory 212 are managed based on timbre waveform directory information in a table format. The timbre waveform directory information is stored in the large-capacity flash memory 212, and is read out by the CPU 202 from the large-capacity flash memory 212 at, for example, the start of the electronic keyboard instrument 100 and transferred to the RAM 208. When a musical sound with a certain timbre is played, the CPU 202 reads out from the RAM 208 the data of timbre waveform directory information corresponding to that timbre for reference.

Here, the timbre waveform directory information table has registered thereon item values for each waveform data included in one timbre with a "timbre number", which include "waveform number" of that waveform data, "minimum velocity", "maximum velocity", "smallest key number" and "largest key number" indicating the ranges of a key area and a velocity in which the sound of the waveform data is to be emitted, "address from waveform area start" indicating an address from the start of the storage area (waveform area) of the timbre transferred to the RAM 208, and "waveform size" indicating the data size of that waveform data, as shown in FIG. 4B. That is, in the timbre waveform directory information, information for each waveform data of each timbre is defined in a table format, which is key area and velocity area information indicating a condition based on which a split is made in the above-described timbre waveform split structure and information regarding an address where the data is actually arranged in the large-capacity flash memory 212 and a waveform size.

(Information on RAM and Large-Capacity Flash Memory)

Next, information on the RAM and the large-capacity flash memory and its transfer processing applied in the electronic keyboard instrument according to the present embodiment are described with reference to the drawings.

Figure 5:
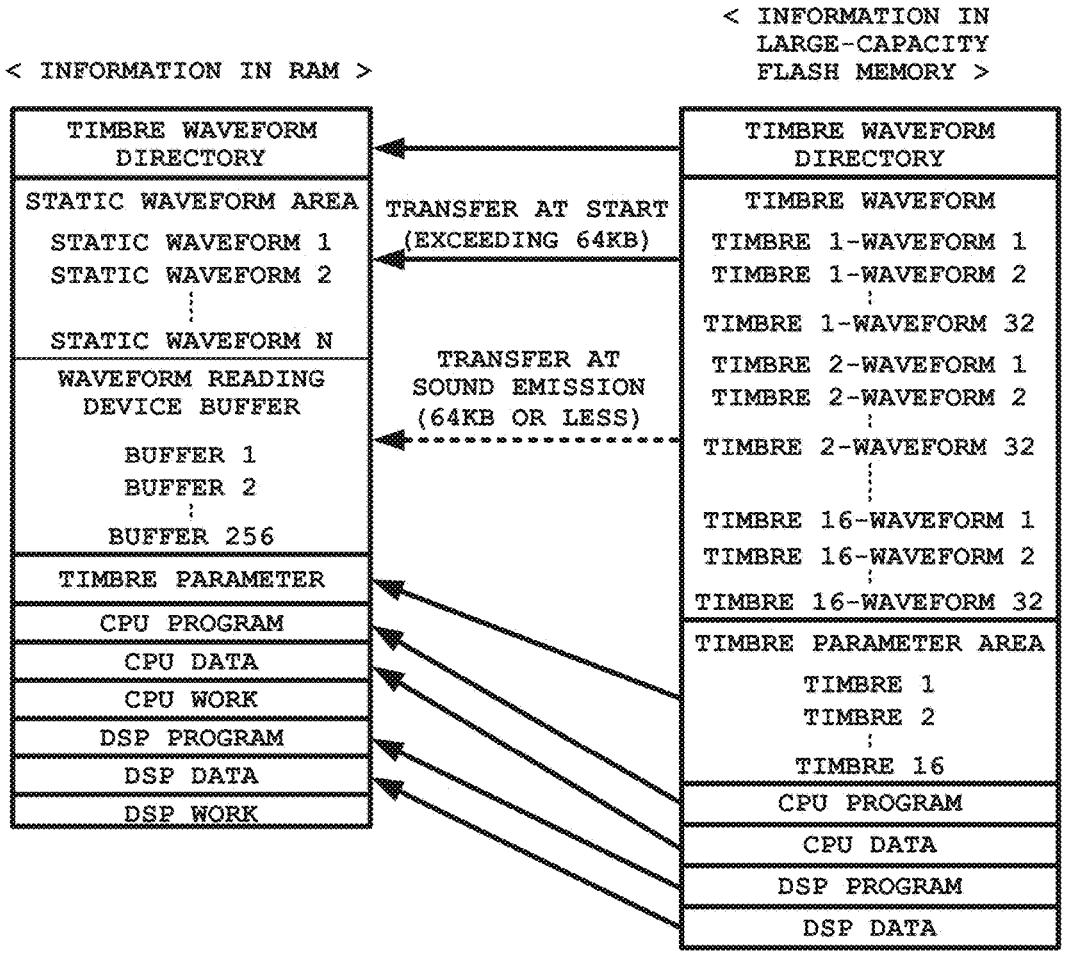
FIG. 5 is a diagram outlining information on a RAN (Random Access Memory) and a large-capacity flash memory and its transfer processing applied in the present embodiment.

FIG. 5 is a diagram outlining information on the RAM and the large-capacity flash memory and its transfer processing applied in the present embodiment. FIG. 6A and FIG. 6B are diagrams for describing a static waveform area and a dynamic waveform area of the RAM applied in the present embodiment. FIG. 6A shows details of a directory on the static waveform area (first storage area), and FIG. 6B shows details of a directory on a waveform reading device buffer area (second storage area) that is the dynamic waveform area.

In the RAM 208, various data are developed, such as the data of a timbre waveform directory, timbre parameters, a CPU program, CPU data, CPU work, a DSP program, DSP data, and DSP work, as shown in "information on RAM" at the left in FIG. 5. Also, in the large-capacity flash memory 212, various data are developed, such as the data of a timbre waveform directory, a timbre parameter area, a CPU program, CPU data, a DSP program, and DSP data, as shown in "information on large-capacity flash memory" at the right in FIG. 5.

Here, when the sound source LSI 204 is to perform a waveform reading operation in a musical performance using the electronic keyboard instrument 100, waveform data to be read out is required to be arranged in the RAM 208. For this reason, for example, when the electronic keyboard instrument 100 is activated, the timbre waveform directory information, the timbre parameters, the CPU program, the CPU data, the DSP program, and the DSP data shown in FIG. 4B are transferred from the large-capacity flash memory 212 to the RAM 208.

Also, at the time of a musical performance by the electronic keyboard instrument 100, waveform data that is a target of a waveform reading operation by the sound source LSI 204 is required to be transferred to the RAM 208. However, since the RAM 208 has a smaller storage capacity as compared to the large-capacity flash memory 212, pieces of timbre waveform data stored in the large-capacity flash memory 212 cannot be entirely arranged in the RAM 208.

In the present embodiment, basically, when a sound is to be emitted by a musical performance, necessary waveform data is read out from the large-capacity flash memory 212, transferred to a waveform buffer assigned for each waveform reading device 304 on the RAM 208 so as to be temporarily stored, and then read out and replayed by the sound source LSI 204. Here, when the waveform data has a large data size, it takes time to transfer the data from the large-capacity flash memory 212 to the RAM 208, which causes a delay in the sound emission, and possibly disrupts the musical performance. In the present embodiment, from among waveform data stored in the large-capacity flash memory 212, all pieces of waveform data having a data size exceeding a predetermined threshold value are transferred in advance to the RAM 208 at any timing prior to the start of a musical performance by the electronic keyboard instrument 100, such as its activation timing (power-up). In the present embodiment, for example, 64K bytes are set as a threshold value defining a data size as a criterion of judgment in waveform data transfer processing. According to this threshold setting, for example, the data size of the timbre waveform of an instrument such as the piano or cymbals is larger than the threshold, and is thus transferred to the RAM 208 at the start.

On the other hand, low-capacity waveform data having a data size equal to or smaller than the threshold value (64K bytes) such as the data of the timbre waveform of an instrument such as the guitar, is transferred from the large-capacity flash memory 212 to the RAM 208 every time a key depression operation is performed for a musical performance. Here, for waveform data transferred from the large-capacity flash memory 212 in a musical performance, from among a plurality of waveform buffers on the RAM 208 set corresponding to the plurality of waveform reading devices 304, a waveform buffer not being used from any waveform reading device 304 is selected for overwriting and storing the transferred waveform data. Alternatively, a waveform buffer with a small number of times of use by the waveform reading devices or with a low frequency of use is preferentially selected, and the selected waveform buffer is overwritten and updated with the transferred waveform data. This management at the time of transferring waveform data from the large-capacity flash memory 212 to a waveform buffer is performed based on management information for managing (on a real time basis) while performing sequential updates as to whether waveform data stored in each waveform buffer of the RAN 208 is being used for sound emission by any waveform reading device 304.

The threshold value applied in the above-described waveform data transfer processing is set based on, for example, a processing load, delay time, and the like of the CPU 202 at the time of a musical performance. Specifically, in a musical performance by the electronic keyboard instrument, the instrument player generally tends to recognize that a response to key depression until sound emission is slow if a total delay time from key depression to emission of a musical sound exceeds approximately 10 msec. In consideration of the processing performance of the CPU 202, a signal delay in a peripheral circuit, and the like, a delay time allowable in processing of transferring each timbre waveform data is calculated. Then, a timbre waveform data size allowing the transfer processing to be completed within this certain allowable delay time and also allowing the storage capacity of the RAM 208 to be minimized as much as possible is set as a threshold value. An example of the threshold value calculated by the inventors based on this condition is 64K bytes.

In the present embodiment, a threshold value is set for the data size of a timbre waveform. However, the present invention is not limited thereto. For example, a configuration may be adopted in which a threshold value is set for a pitch or velocity defining a timbre waveform based on the above-described concept.

Also, in the present embodiment, in order to reduce the processing load and processing time of the CPU 202 during a musical performance, the CPU 202 judges (searches), prior to the processing of transferring waveform data whose data size is equal to or smaller than the threshold value, whether the waveform data of a musical sound specified by a musical performance has been transferred in advance and is present in the RAM 208. If the relevant waveform data is already present in the RAM 208, the CPU 202 does not perform waveform data transfer from the large-capacity flash memory 212, and performs copy transfer between waveform buffers on the same RAM 208.

In the present embodiment, because of the above-described processing, it is only required that a RAM 208 is adopted which has a storage capacity acquired by adding a storage capacity of a waveform buffer which temporarily stores waveform data smaller than the threshold value to a capacity capable of storing all pieces of waveform data exceeding the above-described threshold. According to verification by the inventors, by the present embodiment being applied, the storage capacity for use as a RAM can be compressed to substantially ¼ to ⅕ of a conventional storage capacity.

A "static waveform directory" shown in FIG. 6A indicates details of a directory in the static waveform area of the RAM 208 in the "information on the RAM" shown in FIG. 5 where waveform data exceeding the threshold value (64K bytes) applied to the above-described waveform data transfer processing is stored. When the electronic keyboard instrument 100 is activated, all pieces of waveform data exceeding the threshold value (64K bytes) are transferred from the timbre waveform directory of the large-capacity flash memory 212 to the static waveform area and, at this moment, this static waveform directory is created in the work area (CPU work) of the CPU 202, as shown in. FIG. 5. The details of the static waveform directory are fixedly stored and are not changed after the activation of the electronic keyboard instrument 100.

For each piece of the waveform data (static waveforms 1, 2, . . . , N) transferred from the large-capacity flash memory 212, the static waveform directory has stored therein a timbre number to which the waveform belongs, a timbre waveform number, a start address from a static waveform area where the waveform has been arranged, and the waveform size of the waveform data, as shown in FIG. 6A. Here, the number of static waveforms to be transferred from the large-capacity flash memory 212 and the capacity of the entire waveform data have been defined in advance based on the above-described threshold value, and therefore a static waveform area on the RAM 208 and each area on the static waveform directory have been fixedly assigned corresponding thereto.

A "waveform reading device buffer directory" shown in FIG. 6B indicates details of a directory in the dynamic waveform area of the RAM 208 in the "information on the RAM" shown in FIG. 5 where waveform data equal to or smaller than the threshold value (64K bytes) applied in the above-described waveform data transfer processing is stored. In this waveform reading device buffer directory, at the time of a musical performance by the electronic keyboard instrument 100, waveform data equal to or smaller than the threshold value (64K bytes) is transferred from the timbre waveform directory of the large-capacity flash memory 212 as shown in FIG. 5, and allocated in the work area (CPU work) of the CPU 202. The details of the waveform reading device buffer directory are variably stored with musical performance, and updated at the time of sound emission or silence of a musical sound.

In the waveform reading device buffer directory, a capacity with a fixed length of 64K bytes is assigned for each waveform reading device 304, and waveform buffers 1 to 256 are set corresponding to the 256 waveform reading devices 304 in a one-to-one relation, whereby the electronic keyboard instrument 100 of the present embodiment can emit 256 sounds simultaneously. The waveform reading device buffer directory has stored, for each waveform buffer corresponding to each waveform reading device, a buffer number of the buffer, a transfer flag which is indicating whether the waveform data has been read and is set at the time of completion of transfer, and a timbre number, timbre waveform number, and waveform size as information regarding the waveform loaded into the buffer, as shown in FIG. 6B.

<Electronic Instrument Control Method>

Next, a method of controlling the electronic keyboard instrument (musical sound generation method) according to the present embodiment is described in detail with reference to the drawings. Here, the method of controlling the electronic keyboard instrument including the musical sound generation method, which is a feature of the present invention, is described as a whole. Note that a series of control processing described below is achieved by the CPU 202 and the sound source LSI 204 executing a predetermined control program stored in the RAM 208.

(Method of Using Waveform Data in RAM)

First, a method of using waveform data in the RAM 208 applied in the electronic keyboard instrument 100 according to the present embodiment is described. In the electronic keyboard instrument 100 according to the present embodiment, at the time of key depression by the instrument player, the CPU 202 first determines a waveform reading device 304 of the sound source LSI 204 to which the key depression is assigned by a key assigner because the number of simultaneous sound emissions is large (that is, many sound emission channels are present). Here, a key assignment to a waveform reading device 304 where sound emission has been stopped is prioritized.

Next, based on the velocity and key area at the time of the key depression, the CPU 202 identifies the waveform number of a musical sound specified by the musical performance from the timbre waveform split information shown in FIG. 4A, and judges whether the relevant waveform data is present in the timbre waveform directory in the RAM 208 shown in FIG. 5. Here, the CPU 202 first judges whether the relevant waveform data is present in the static waveform area of the timbre waveform directory in the RAM 208 and, if the relevant data is not present in the static waveform area, further judges whether the relevant waveform data is present in the waveform reading device buffer area.

When the relevant waveform data is present in the static waveform area in the RAM 208, the CPU 202 takes the relevant waveform data as a reading operation target for sound emission described below. Also, when the relevant waveform data is not present in the static waveform area but in the waveform reading device buffer area, the CPU 202 copies and transfers the waveform data to a wave buffer corresponding to the waveform reading device 304 that is a sound emission assignment target, in the same RAM 208.

This allows the waveform data to be arranged in the RAM 208 in a very short time as compared to transfer processing from the large-capacity flash memory 212 to the RAM 208. When the relevant waveform data is already present in the waveform buffer corresponding to the assigned waveform reading device 304, the waveform data is not required to be transferred, and the already present waveform data is used for a reading operation for sound emission. On the other hand, when the relevant waveform data is not present in both the static waveform area and the waveform reading device buffer area, the CPU 202 transfers the relevant waveform data stored in the large-capacity flash memory 212 to the RAM 208.

When the waveform data of the specified musical sound is present in the RAM 208 and the position of the waveform buffer corresponding to the assigned waveform reading device 304 is defined, the CPU 202 starts a reading operation for sound emission in the sound source LSI 204.

Hereafter, an electronic keyboard instrument control method where the above-described waveform data using method has been applied is described in detail.

(Main Routine)

Figure 7:
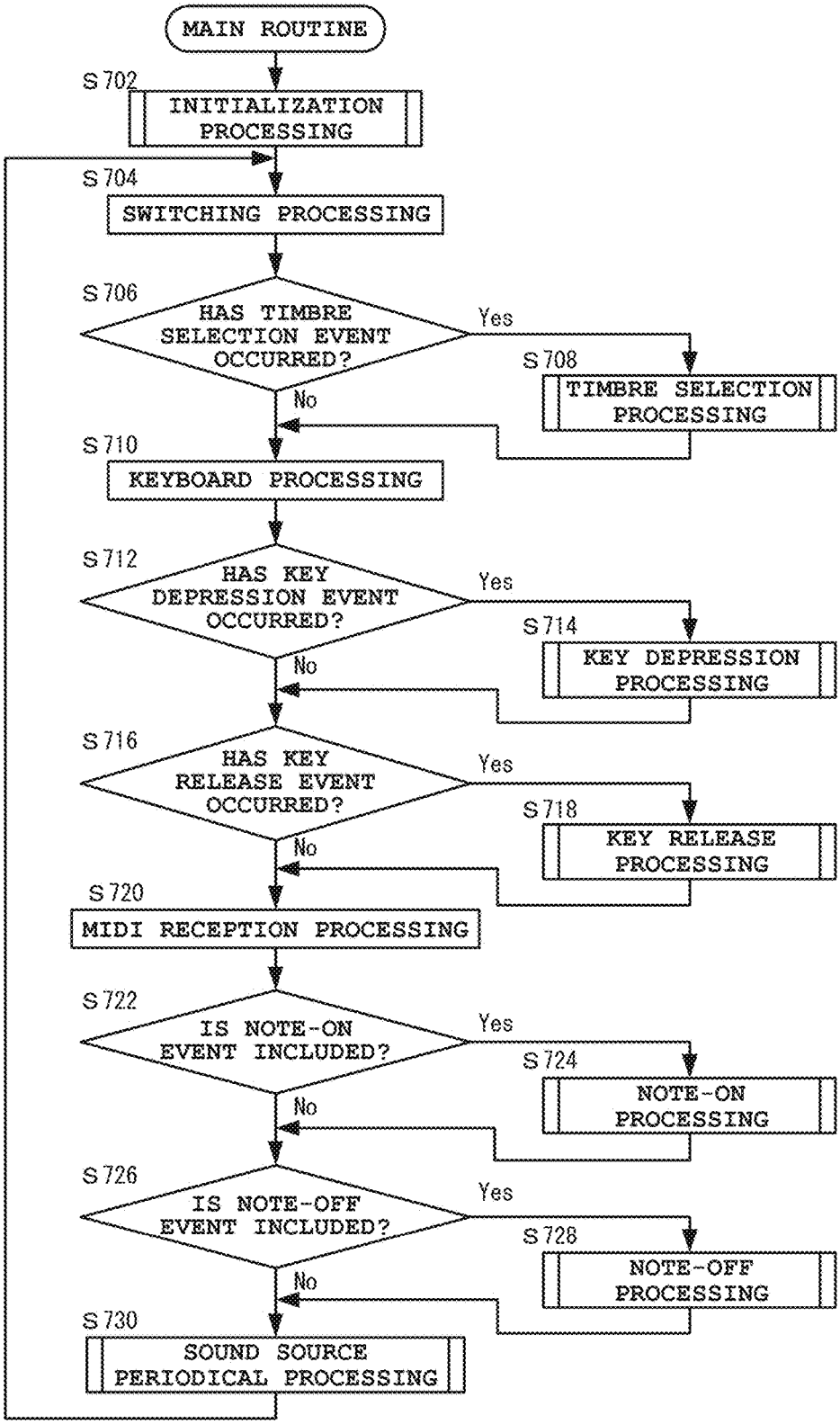
FIG. 7 is a flowchart of the main routine of an electronic keyboard instrument control method according to the present embodiment.

FIG. 7 is a flowchart of the main routine of the electronic keyboard instrument control method according to the present embodiment.

In the electronic keyboard instrument control method according to the present embodiment, processing operations described below are generally performed. First, when the instrument player powers up a device power supply of the electronic keyboard instrument 100, the CPU 202 starts the main routine shown in FIG. 7 to perform initialization processing for initializing each section of the device (Step S702)

Next, when the initialization processing is completed, the CPU 202 repeatedly performs (Steps S704 to S708) a series of processing operations including switching processing when the instrument player operates any timbre selection button 104 or the like, keyboard processing (Steps S710 to S718) for processing a key depression event and a key release event when the instrument player plays the keyboard 102, MIDI reception processing (Steps S720 to S728) for processing a note-on event and a note-off event of a MIDI (Musical Instrument Digital Interface) message received from outside the electronic keyboard instrument 100, and sound source periodical processing (Step S730) for performing processing for each predetermined time in the sound source.

Although not shown in the flowchart of FIG. 7, when a state change such as the end or interruption of a musical performance mode or the power-off of the device power supply is detected during the above-described processing operations (Steps S702 to S730), the CPU 202 forcibly ends the main routine.

Hereafter, each of the above-described processing operations is specifically described.

(Initialization Processing)

Figure 8:
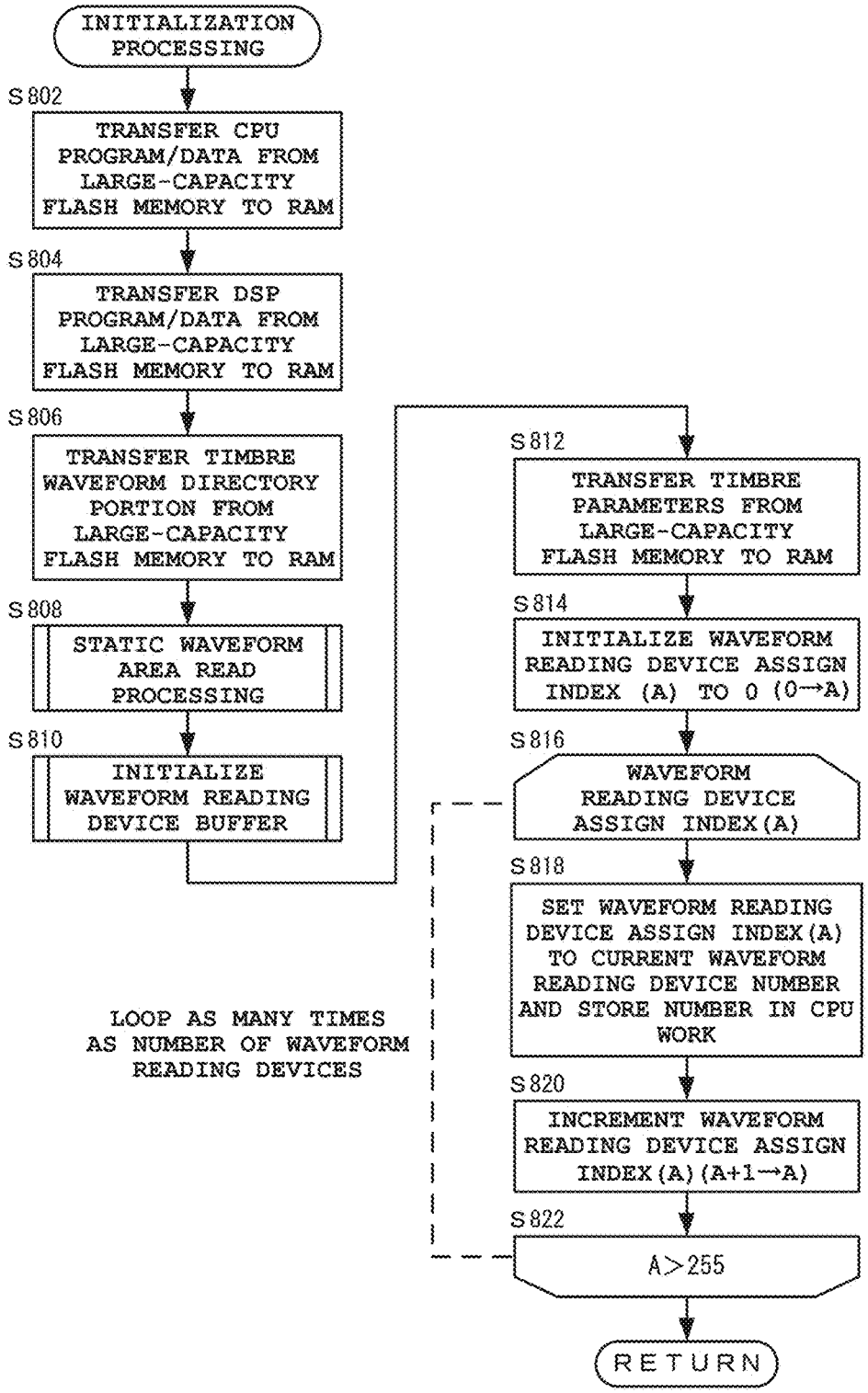
FIG. 8 is a flowchart of initialization processing applied in the electronic keyboard instrument control method according to the present embodiment.

FIG. 8 is a flowchart of the initialization processing applied in the electronic keyboard instrument control method according to the present embodiment.

In the initialization processing applied in the electronic keyboard instrument control method according to the present embodiment, after transferring the CPU program, the CPU data, the DSP program, and the DSP data from the large-capacity flash memory 212 to the RAM 208 (Steps S802 and S804), the CPU 202 further transfers a timbre waveform directory portion from the large-capacity flash memory 212 to an address specified on the RAM 208 (Step S806), as shown in the flowchart of FIG. 8. Here, the timbre waveform directory portion has a table format having organized therein key area and velocity area information serving as a split condition, an arrangement address in the large-capacity flash memory 212, and information regarding a wavelength size for each waveform of each timbre, as shown in FIG. 4B.

Next, the CPU 202 performs static waveform area read processing of constructing a static waveform area portion and the static waveform directory shown in FIG. 6A to be transferred from this timbre waveform directory into the RAM 208, in the RAM 208 at the time of starting the electronic keyboard instrument 100 (Step S808).

Next, the CPU 202 performs waveform reading device buffer initialization processing of initializing a waveform buffer corresponding to each waveform reading device 304 so as to construct the waveform reading device buffer directory portion shown in FIG. 6B which is used by the waveform reading device 304 of the sound source LSI 204 for performing a waveform data reading operation (Step S810).

Next, the CPU 202 transfers timbre parameters required for sound emission such as a pitch, filter, and sound-volume setting from the large-capacity flash memory 212 into the RAM 208 (Step S812).

Next, for the waveform reading device 304, the CPU 202 initializes to "0" a waveform reading device assign index A for managing the performed time of a waveform buffer assignment (Step S814).

Next, for the waveform reading device 304, the CPU 202 sets and stores the waveform reading device assign index A in the CPU work (Step S818) and then increments the waveform reading device assign index A (Step S820). The CPU 202 performs loop processing (Steps S816 and S822) of repeating the above-described series of processing operations (Steps S818 to S820) as many times as the number of waveform reading devices 304 (256 in the present embodiment) and thereby sets a unique assign index to each waveform reading device 304.

(Static Waveform Area Reading Processing)

Figure 9:
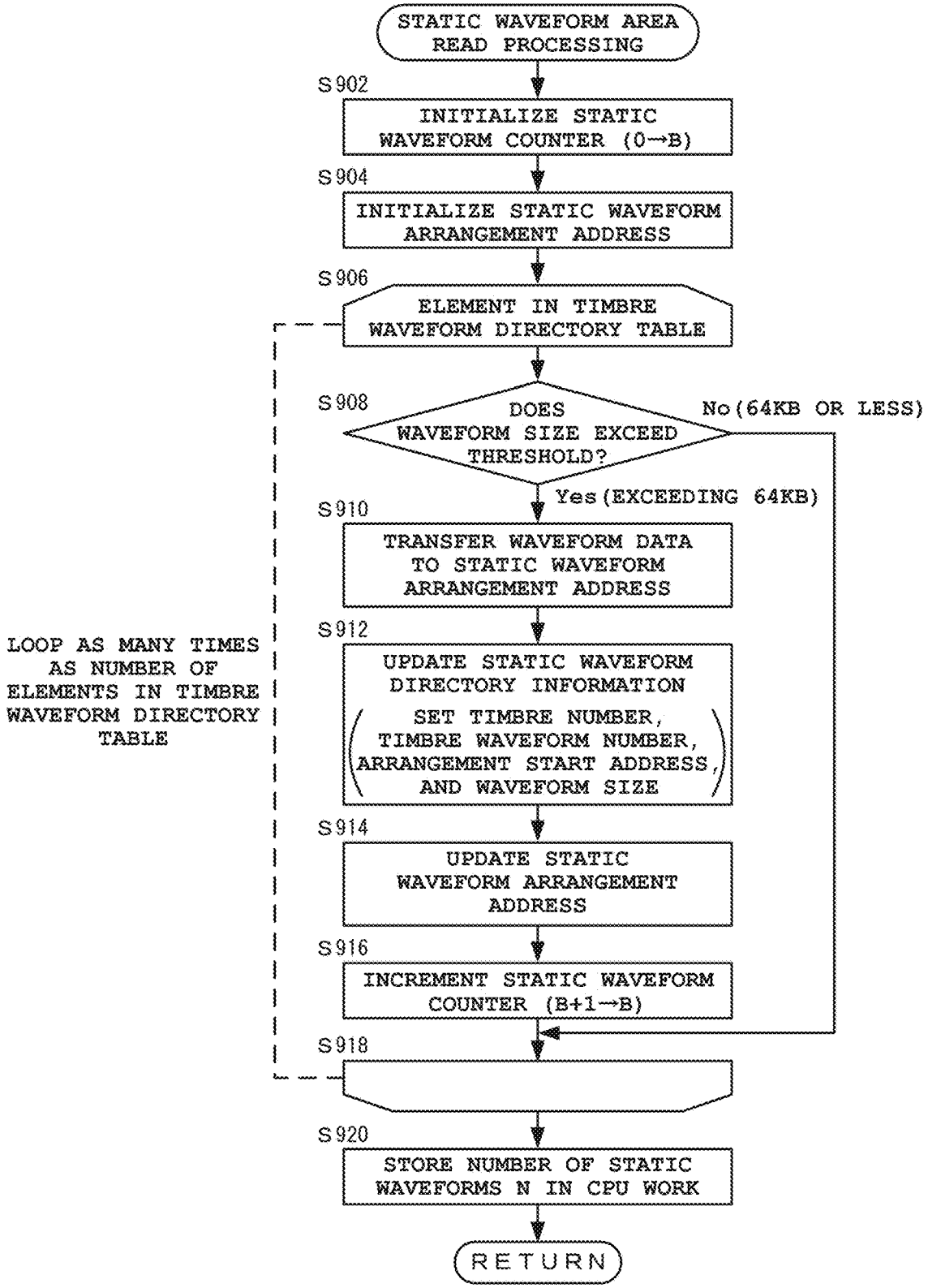
FIG. 9 is a flowchart of static waveform area read processing applied in the initialization processing of the electronic keyboard instrument control method according to the present embodiment.

FIG. 9 is a flowchart of static waveform area read processing applied in the initialization processing of the electronic keyboard instrument control method according to the present embodiment.

In the static waveform area read processing applied in the initialization processing described above, the CPU 202 first initializes to "0" a counter B for managing the number of static waveforms (Step S902), as shown in the flowchart in FIG. 9. Next, as address information when a static waveform is transferred into the RAM 208, the CPU 202 sets a start address where the static waveform is to be arranged for initialization (Step S904).

Next, the CPU 202 confirms the waveform size sequentially from the start of the timbre waveform directory table, and judges whether the waveform is a static waveform having a waveform size exceeding the threshold value (64K bytes) set in advance (Step S908). When the waveform size exceeds the threshold (64K bytes), the CPU 202 judges that the waveform is a static waveform, and transfers the waveform data for that size from the large-capacity flash memory 212 to the address in the RAM 208 in the above-described address information (Step S910). Here, as static waveform directory information, the CPU 202 sets the timbre number, the timbre waveform number, the arrangement start address, and the waveform size of the transferred waveform data in the CPU work (Step S912).

Next the CPU 202 adds the waveform size of the transferred waveform data to the address of the address information so as to update the address information of the waveform arranged in the RAM 208 (Step S914), and increments the counter B which manages the number of static waveforms (Step S916). On the other hand, when the waveform size is equal to or smaller than the threshold value (64K bytes), the CPU 202 does not transfer the static waveform data, and maintains the current settings. The CPU 202 performs loop processing (Steps S906 and S918) of repeating the above-described series of processing operations (Steps S908 to S916) as many times as the number of elements on the timbre waveform directory table (that is, until the last element of the table information). After the loop processing is ended, the CPU 202 stores the number of static waveforms in the CPU work (Step S920).

(Waveform Reading Device Buffer Initialization Processing)

Figure 10:
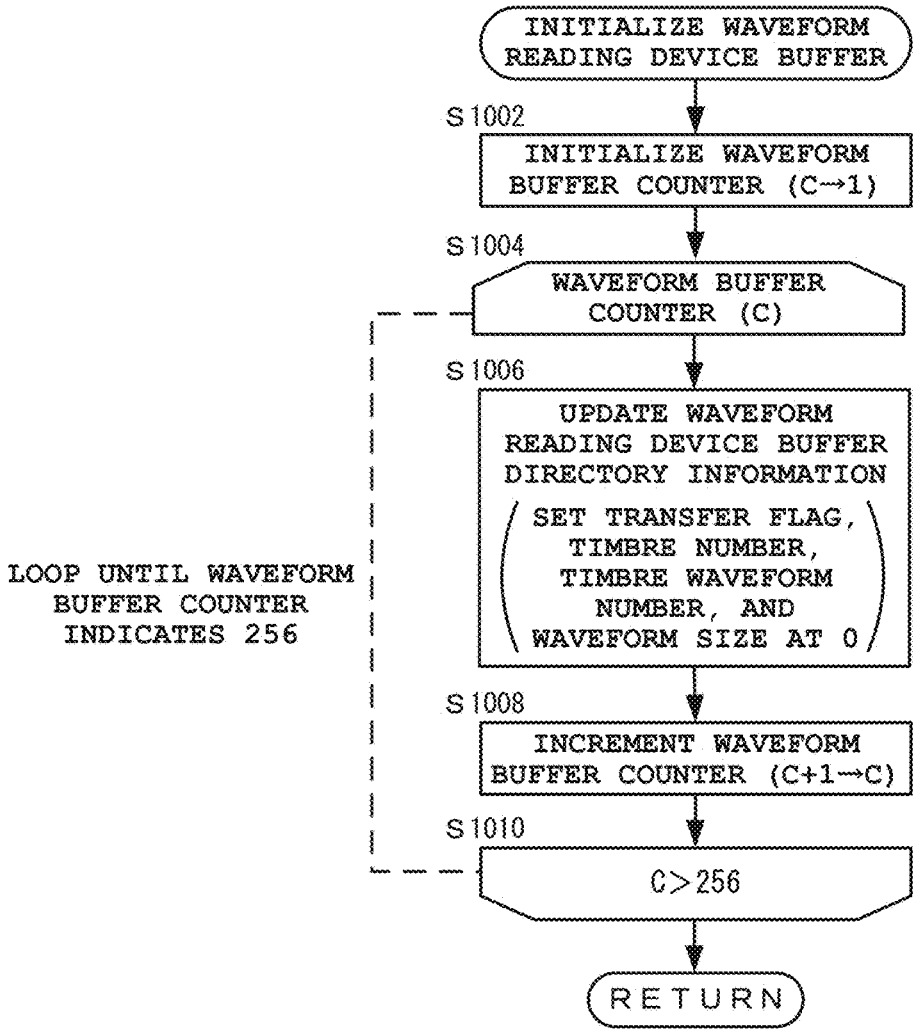
FIG. 10 is a flowchart of waveform reading device buffer initialisation processing applied in the initialization processing of the electronic keyboard instrument control method according to the present embodiment.

FIG. 10 is a flowchart of waveform reading device buffer initialization processing applied in the initialization processing of the electronic keyboard instrument control method according to the present embodiment.

It the waveform reading device buffer initialization processing applied in the above-described initialization processing, the CPU 202 first sets a counter (C) which manages the numbers of waveform buffers arranged in the RAM 208 at "1" for initialization (Step S1002), as shown in the flowchart in FIG. 10. Next, sequentially from a waveform buffer with a buffer number of "1", the CPU 202 sets the transfer flag, the timbre number, the timbre waveform number, and the waveform size stored in the waveform reading device buffer directory at "0" (Step S1006).

Next, the CPU 202 increments the counter (C) which manages the numbers of waveform buffers arranged in the RAM 208 (Step S1008). The CPU 202 performs loop processing (Steps S1004 and S1010) of repeating the above-described series of processing operations (Steps S1006 to S1008) in each of the 256 wave buffers having a one-to-one relation with the 256 waveform reading devices so as to initialize each wave buffer.

(Switching Processing)

Figure 11:
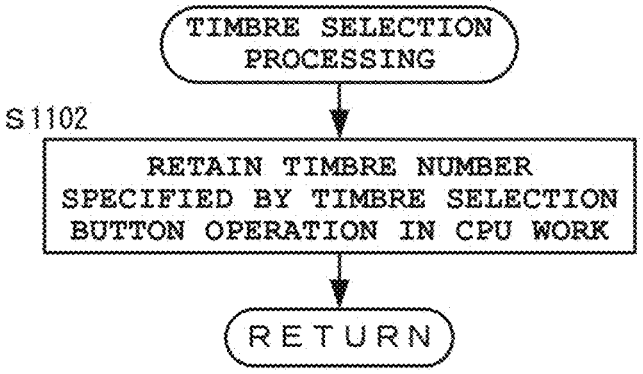
FIG. 11 is a flowchart of timbre selection processing applied in switching processing of the electronic keyboard instrument control method according to the present embodiment.

FIG. 11 is a flowchart of timbre selection processing applied in switching processing of the electronic keyboard instrument control method according to the present embodiment In the switching processing performed when the instrument player operates a button, switch, or the like provided on the electronic keyboard instrument 100 (Step S704), the CPU 202 judges whether a timbre selection event has occurred by that switching operation (Step S706). When judged that a timbre selection event has occurred, the CPU 202 performs timbre selection processing (Step S708).

In the timbre selection processing, as in the flowchart shown in FIG. 11, the CPU 202 stores a timbre number specified by the instrument player operating a timbre selection button 104 in the CPU work in the RAM 208 for use in, for example, key depression processing described below or the like (Step S1102). On the other hand, when the CPU 202 judges that a timbre selection event has not occurred or when the above-described timbre selection processing is ended, the CPU 202 performs keyboard processing described below (Step S710).

(Keyboard Processing)

Figure 12A:
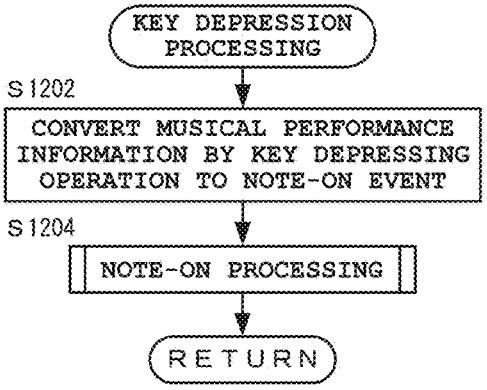
FIG. 12A and FIG. 12B are flowcharts of key depression processing and key release processing applied in keyboard processing of the electronic keyboard instrument control method according to the present embodiment.
Figure 12B:
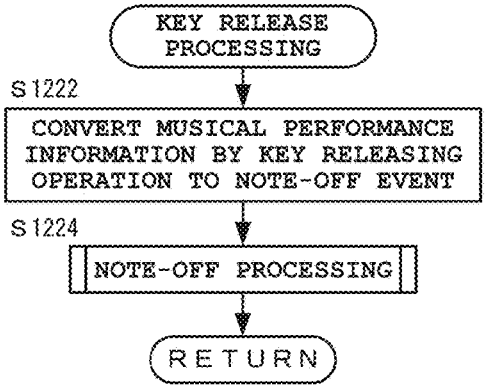
Figure 13A:
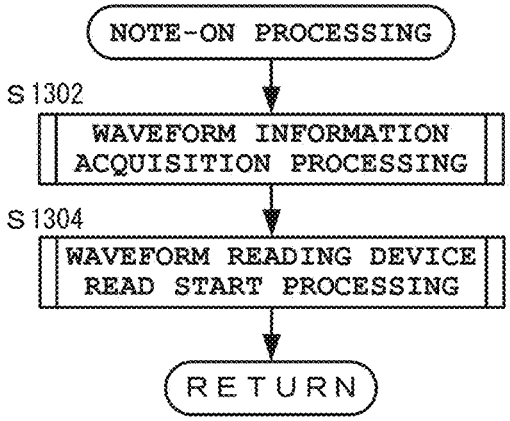
FIG. 13A and FIG. 13B are flowcharts of note-on processing and note-off processing applied in the keyboard processing of the electronic keyboard instrument control method according to the present embodiment.
Figure 13B:
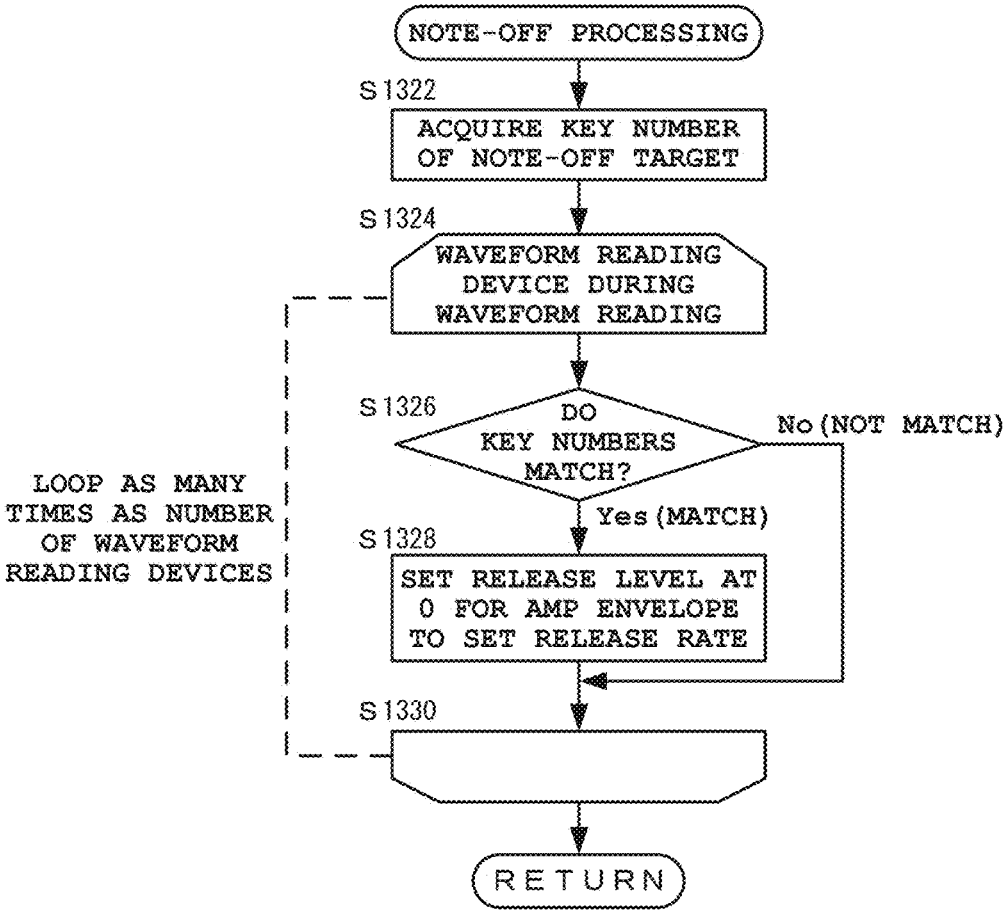

FIG. 12A and FIG. 12B are flowcharts of key depression processing and key release processing applied in keyboard processing of the electronic keyboard instrument control method according to the present embodiments FIG. 13A and FIG. 13B are flowcharts of note-on processing and note-off processing applied in the keyboard processing of the electronic keyboard instrument control method according to the present embodiment.

In the keyboard processing (Step S710) performed after the above-described switching processing (Step S704), the CPU 202 judges whether or not a key depression event or a key release event has occurred by the instrument player operating the keyboard 102 provided on the electronic keyboard instrument 100 (Steps S712 and S716). When judged that a key depression event has occurred, the CPU 202 performs key depression processing described below (Step S714). When judged that a key release event has occurred, the CPU 202 performs key release processing described below (Step S718).

In the key depression processing, the CPU 202 converts a keyboard position and a depression strength included in musical performance information based on a key depressing operation performed by the instrument player playing the keyboard 102 to a key number (note number) and a velocity, respectively, retains them as note-on information (Step S1202), and performs processing with it as a note-on event (Step S1204), as shown in the flowchart in FIG. 12A.

In the note-on processing, the CPU 202 first performs processing of acquiring waveform information from the note-on information acquired by the conversion from the musical performance information in the key depression processing (Step S1302), and then performs read start processing in the waveform reading device 304 of the sound source LSI 204 (Step S1304), as shown in the flowchart in FIG. 13A.

Also, in the key release processing, the CPU 202 converts a keyboard position included in musical performance information based on a key release operation performed by the instrument player playing the keyboard 102 to a key number (note number), retains the key number as note-off information (Step S1222), and performs processing with it as a note-off event (Step S1224), as shown in the flowchart in FIG. 12B.

In the note-off processing, the CPU 202 first acquires the key number (note number) from the note-off information acquired by the conversion from the musical performance information in the key release processing (Step S1322), as shown in the flowchart in FIG. 13B. Next, sequentially from a waveform reading device 304 with a number of "1", the CPU 202 judges the status of the waveform reading device 304 and, for each waveform reading device 304 reading waveform data, acquires a key number corresponding to the waveform reading device 304 from the CPU work in the RAM 208 so as to judge whether this key number matches the key number acquired from the note-off information (Step S1326). When the key numbers match, the CPU 202 sets a release level at "0" for the sound volume control (amp envelope) connected to the waveform reading device 304, and sets a release rate acquired from the timbre parameters in the RAM 208 (Step S1325). On the other hand, when the key numbers do not match, the CPU 202 maintains the current setting of the amp envelope. The CPU 202 performs loop processing (Steps S1324 and S1330) of repeating the above-described series of processing operations (Steps S1326 to S1328) as many times as the number of waveform reading devices 304 reading waveform data.

Here, each processing operation applied in the note-on processing performed in the above-described keyboard processing is described in detail.

(Waveform Information Acquisition Processing)

Figure 14:
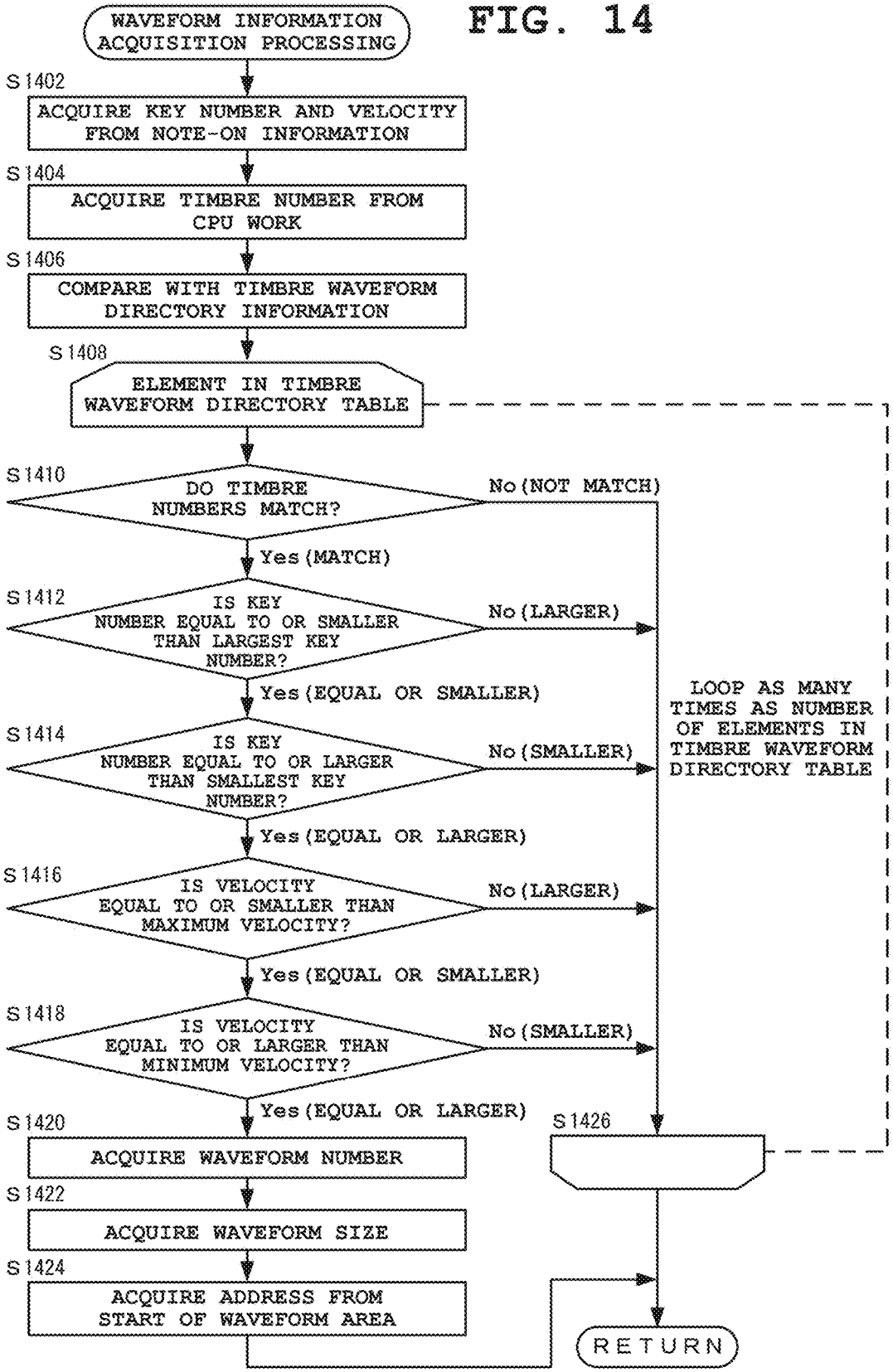
FIG. 14 is a flowchart of waveform information acquisition processing applied in note-on processing of the electronic keyboard instrument control method according to the present embodiment.

FIG. 14 is a flowchart of waveform information acquisition processing applied in the note-on processing of the electronic keyboard instrument control method according to the present embodiment.

In the waveform information acquisition processing performed in the note-on processing, the CPU 202 first acquires the key number (note number) and the velocity from the note-on information acquired in the key depression processing (Step S1402), and also acquires the timbre number stored in the timbre selection processing from the CPU work in the RAM 208 (Step S1404), as shown in the flowchart in FIG. 14.

Next, sequentially from the start of the timbre waveform directory table, the CPU 202 makes a comparison as to whether the acquired key number, velocity, and timbre number match those of the table information (Step S1406). In this comparison processing, the CPU 202 extracts table information where the timbre number matches the acquired timbre number, the key number is equal to or smaller than the largest key number and is equal to or larger than the smallest key number, and the velocity is equal to or smaller than the maximum velocity and equal to or larger than the minimum velocity (Steps S1410 to S1418) and acquires a waveform number, a waveform size, and an address from the start of the waveform area in the table (Steps S1420 to S1424). On the other hand, in the above-described comparison processing, the CPU 202 does not acquire waveform information such as a waveform number when the timbre numbers do not match, the key number is larger than the largest key number or smaller than the smallest key number, or the velocity is larger than the maximum velocity or smaller than the minimum velocity. The CPU 202 performs loop processing (Steps S1408 and S1426) of repeating the above-described series of processing operations (Steps S1410 to S1418) as many times as the number of elements on the timbre waveform directory table (that is, until the last element of the table information).

(Waveform Read Start Processing)

Figure 15:
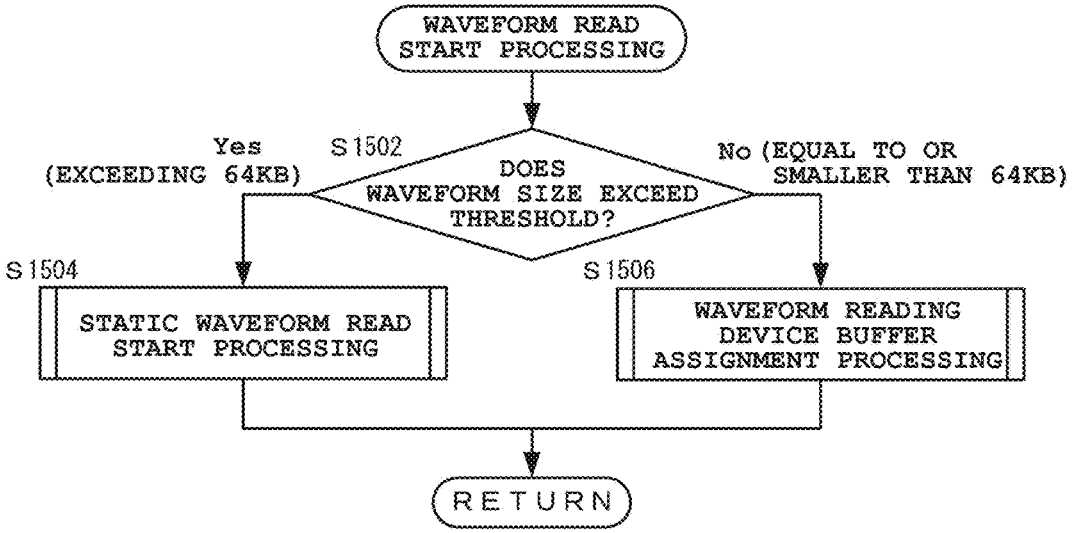
FIG. 15 is a flowchart of waveform read start processing by a waveform reading device applied in the note-on processing of the electronic keyboard instrument control method according to the present embodiment.

FIG. 15 is a flowchart of waveform read start processing by the waveform reading device applied in the note-on processing of the electronic keyboard instrument control method according to the present embodiment.

In the waveform read start processing that is performed by the waveform reading device in the note-on processing, the CPU 202 judges whether the waveform size acquired in the waveform information acquisition processing exceeds the threshold value (64K bytes) set in advance (Step S1502). When the waveform size exceeds the threshold value (64K bytes), the CPU 202 performs static waveform read start processing described below (Step S1504), as in the flowchart shown in FIG. 15. On the other hand, when the waveform size is equal to or smaller than the threshold value (64K bytes), the CPU 202 performs waveform reading device buffer assignment processing described below (Step S1506).

(Static Waveform Read Start Processing)

Figure 16:
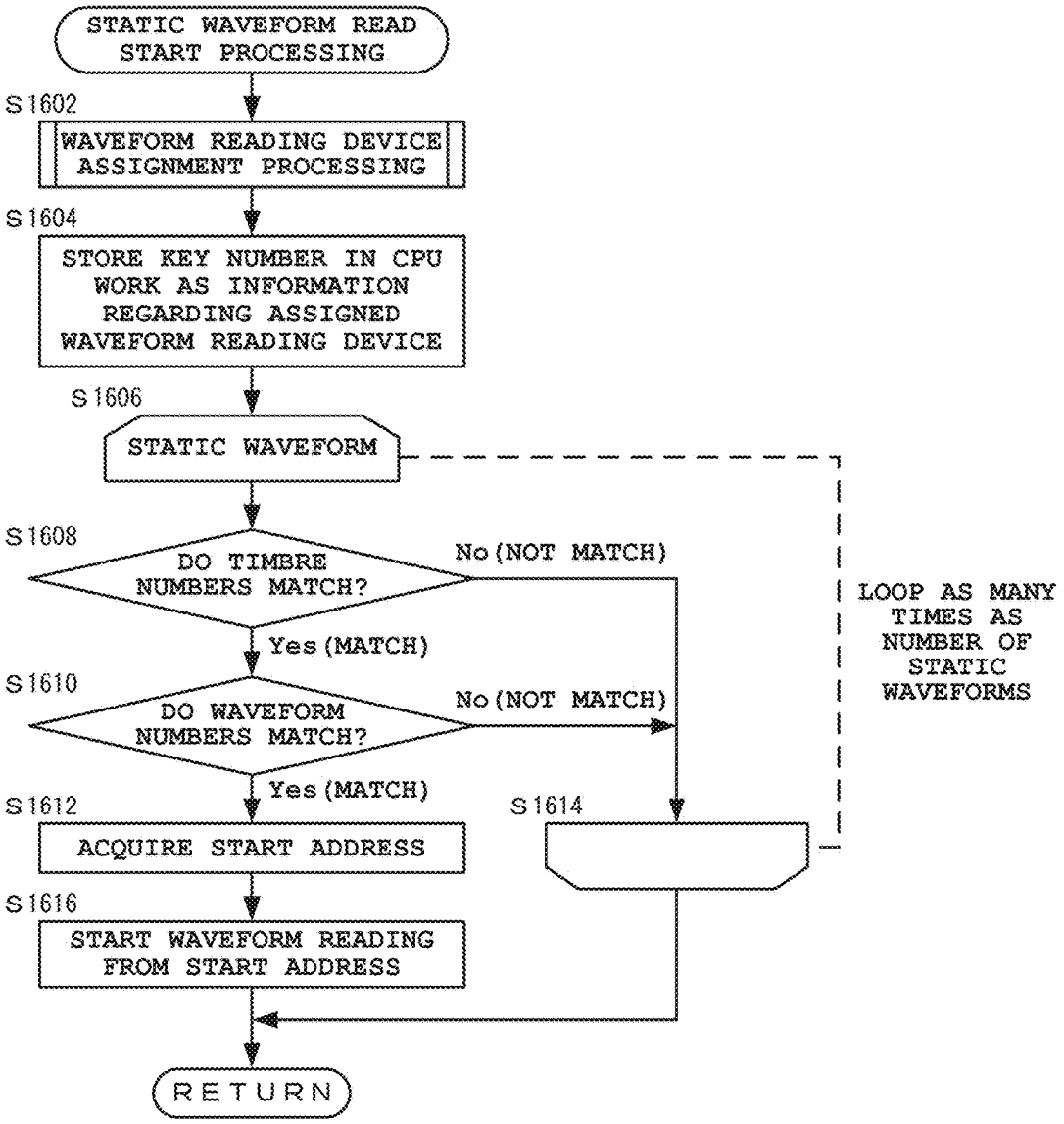
FIG. 16 is a flowchart of static waveform read start processing applied in the note-on processing of the electronic keyboard instrument control method according to the present embodiment.

FIG. 16 is a flowchart of static waveform read start processing applied in the note-on processing of the electronic keyboard instrument control method according to the present embodiment.

In the static waveform read start processing that is performed when the waveform size acquired in the note-on processing exceeds the threshold (64K bytes), the CPU 202 first performs assignment processing for determining which waveform reading device 304 is to be used in the waveform generator 302 of the sound source LSI 204 (Step S1602), as in the flowchart shown in FIG. 16. The processing of assigning a waveform reading device 304 will be described further below. Next, as information regarding the assigned waveform reading device 304, the CPU 202 stores the key number acquired in the key depression processing for use in the key release processing (note-off processing) and the like, in the CPU work in the RAN 208 (Step S1604).

Next, sequentially from the start of the static waveform directory, the CPU 202 makes a comparison as to whether the timbre number and the waveform number acquired in the above-described timbre selection processing and waveform information acquisition processing match those of the directory information (Steps S1608 and S1610). When the acquired timbre number and waveform number both match those of the directory information, the CPU 202 acquires the start address where the waveform has been arranged in the RAM 208 based on the static waveform number (Step S1612), and starts a waveform reading operation by the assigned waveform reading device 304 from the acquired start address (Step S1616). On the other hand, in the above-described comparison processing, if either one of the acquired timbre number or waveform number does not match a relevant one of the directory information, the CPU 202 does not acquire the start address. The CPU 202 performs loop processing (Steps S1606 and S1614) of repeating the above-described series of processing operations (Steps S1608 to S1612) as many times as the number of static waveforms stored in the CPU work.

(Waveform Reading Device Assignment Processing)

Figure 17:
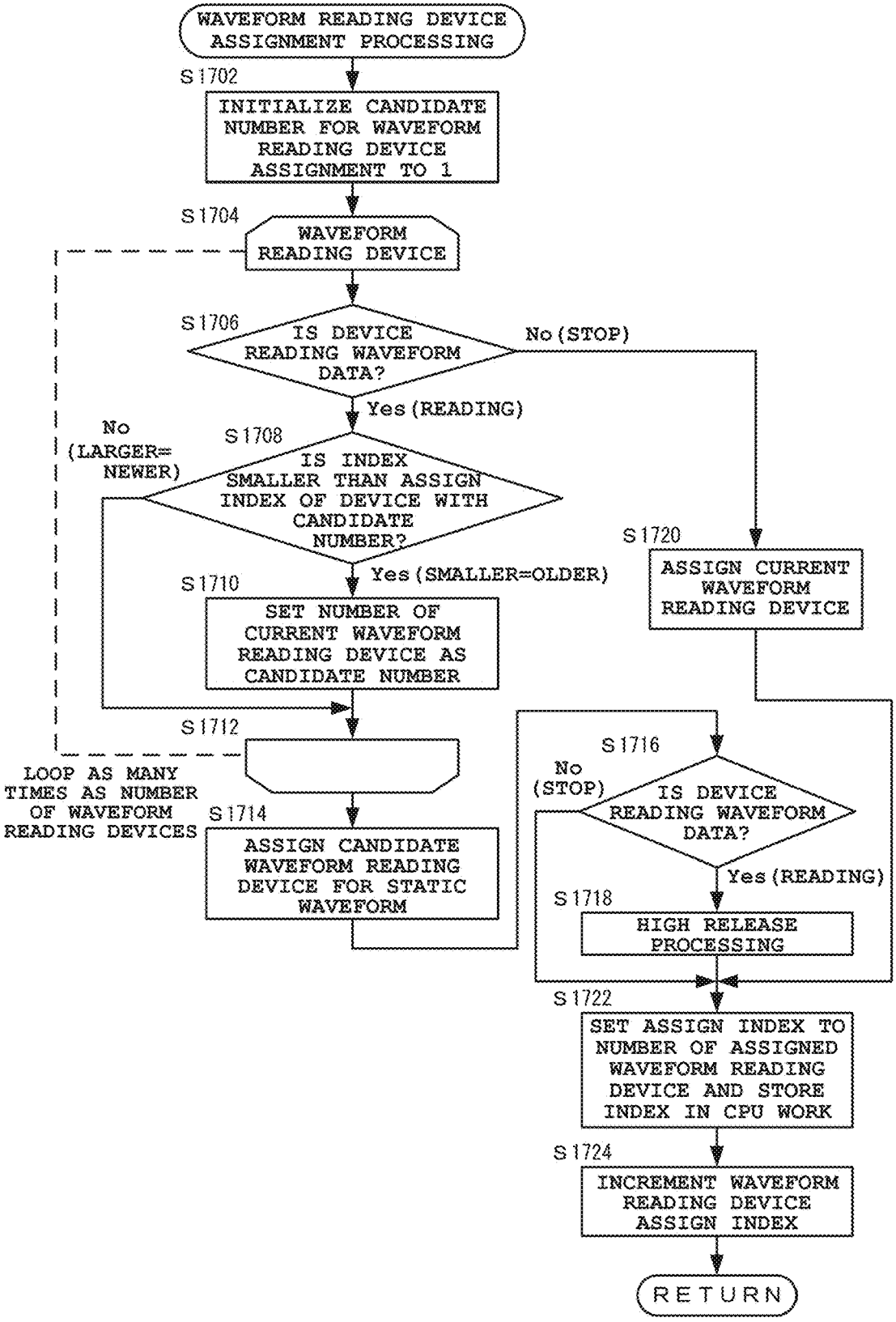
FIG. 17 is a flowchart of waveform reading device assignment processing applied in the note-on processing of the electronic keyboard instrument control method according to the present embodiment.

FIG. 17 is a flowchart of waveform reading device assignment processing applied in the note-on processing of the electronic keyboard instrument control method according to the present embodiment.

In the waveform reading device assignment processing that is performed in the above-described static waveform read start processing, the CPU 202 first provisionally sets a candidate number for waveform reading device 304 assignment at "1" for initialization (Step S1702), as in the flowchart shown in. FIG. 17.

Next, sequentially from the waveform reading device 304 with a number of "1", the CPU 202 judges the status of the waveform reading device 304 so as to judge whether the device is reading waveform data (Step S1706). When judged that the waveform reading device 304 is not reading waveform data (stops), the CPU 202 assigns that waveform reading device 304 (Step S1720), and then performs processing operations at Step S1722 and the following steps described below. On the other hand, when judged that the current waveform reading device 304 is reading waveform data, the CPU 202 makes a comparison as to whether the waveform reading device assign index of the current waveform reading device 304 is smaller than the waveform reading device assign index of the waveform reading device 304 with the candidate number (Step S1708).

When the waveform reading device assign index of the current waveform reading device 304 is smaller than the waveform reading device assign index of the waveform reading device 304 with the candidate number, the CPU 202 judges that the current waveform reading device 304 is older than the candidate waveform reading device 304 and updates, to the number of the current waveform reading device 304, the candidate number of the waveform reading device 304 to be assigned. On the other hand, in the above-described comparison processing, when the waveform reading device assign index of the current waveform reading device 304 is larger than the waveform reading device assign index of the waveform reading device 304 with the candidate number, the CPU 202 judges that the current waveform reading device 304 is newer than the candidate waveform reading device 304, and therefore does not update the number of the waveform reading device 304. The CPU 202 performs loop processing (Steps S1704 and S1712) of repeating the above-described series of processing operations (Steps S1706 to S1710) as many times as the number of waveform reading devices 304.

After the loop processing has ended, if the number of the waveform reading device 304 to be assigned has not been defined when status confirmation is performed by an amount equal to the number of waveform reading devices 304, the CPU 202 assigns the waveform reading device with the candidate number for static waveform (Step S1714). Here, the CPU 202 judges whether the assigned waveform reading device 304 is reading waveform data (Step S1716). If the device is reading waveform data, the CPU 202 performs high release processing (processing of rapidly setting the sound volume level at "0" in the sound volume control connected to the waveform reading device 304) (Step S1718), and then stops the waveform reading operation of the assigned waveform reading device 304. On the other hand, if the device is not reading waveform data, the CPU 202 judges that the waveform reading device 304 is in a stopped state, and maintains the current settings.

Next, the CPU 202 sets the waveform reading device assign index to the assigned waveform reading device 304 and stores the assign index in the CPU work (Step S1722). Then, the CPU 202 increments the waveform reading device assign index (Step S1724). By this processing, if no waveform reading device 304 not reading waveform data is present, the CPU 202 assigns a waveform reading device 304 with the oldest waveform reading device as index.

(Waveform Reading Device Buffer Assignment Processing)

Figure 18:
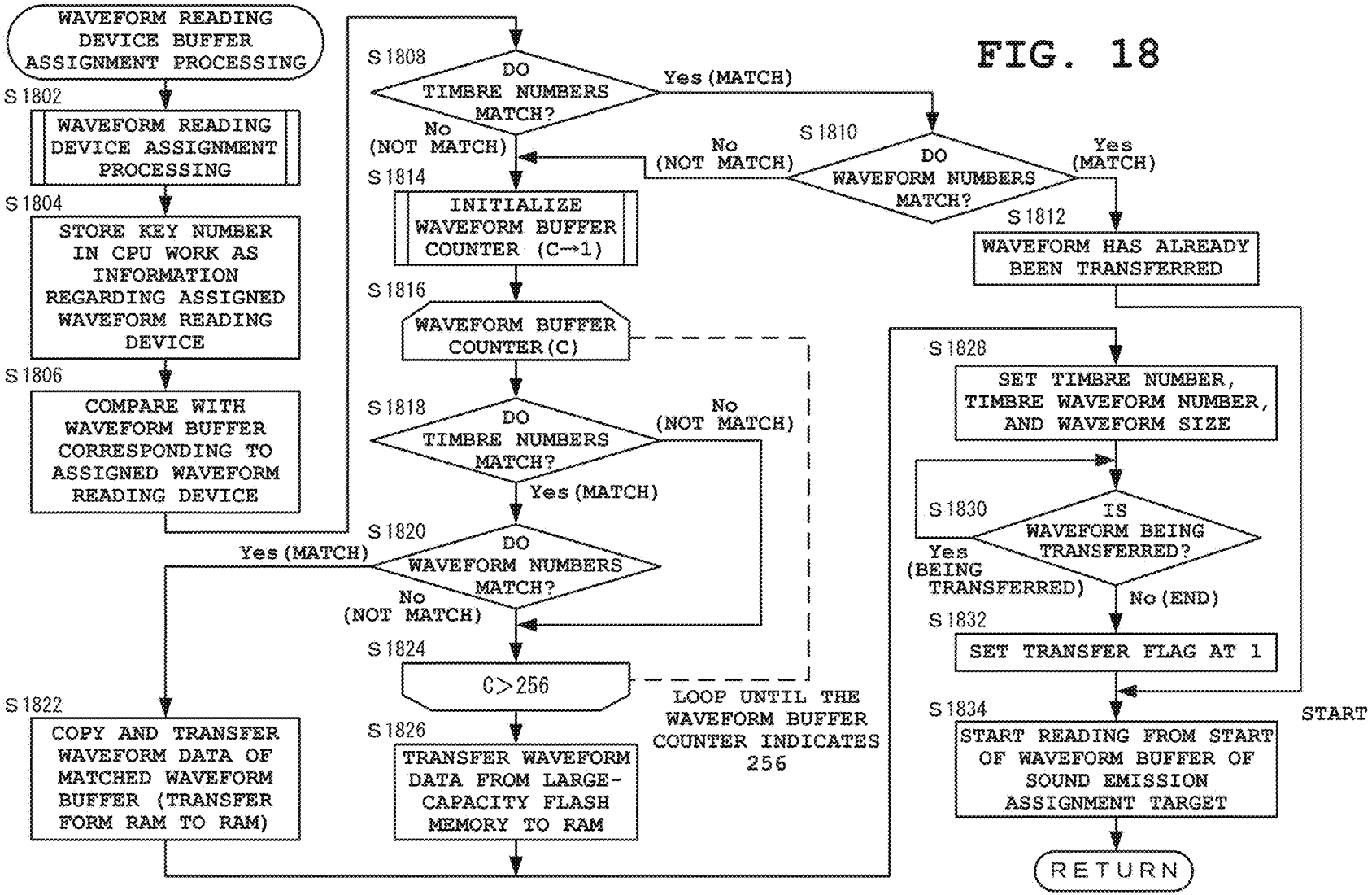
FIG. 18 is a flowchart of waveform reading device buffer assignment processing applied in the note-on processing of the electronic keyboard instrument control method according to the present embodiment.

FIG. 18 is a flowchart of waveform reading device buffer assignment processing applied in the note-on processing of the electronic keyboard instrument control method according to the present embodiment.

In the waveform reading device buffer assignment processing that is performed when the waveform size acquired in the note-on processing is equal to or smaller than the threshold value (64K bytes), the CPU 202 first performs assignment processing of determining which waveform reading device 304 is to be used in the waveform generator 302 of the sound source LSI 204 (S1802), as in the flowchart shown in FIG. 18. Here, processing equivalent to the processing of assigning the waveform reading device 304 (Step S1602) shown in FIG. 16 and FIG. 17 is applied.

Next, as information regarding the assigned waveform reading device 304, the CPU 202 stores the key number at this point in the CPU work (Step S1804). Next, the CPU 202 makes a comparison as to whether the timbre number and waveform number acquired in the above-described timbre selection processing and waveform information acquisition processing match those of the information of the waveform buffer corresponding to the assigned waveform reading device 304 (Steps S1806 to S1810). When the acquired timbre number and waveform number both match those of the information regarding the waveform buffer, the CPU 202 judges that the waveform data has already been transferred (Step S1812), and starts a waveform reading operation from the start of the waveform buffer of the sound emission assignment target (Step S1834). On the other hand, in the above-described comparison processing, when either one of the timbre number and the waveform number does not match a relevant one of the information regarding the waveform buffer, the CPU 202 judges whether the waveform data has already been transferred to another waveform buffer.

First, the CPU 202 sets the waveform buffer counter (C) at "1" for initialization (Step S1814) and, from the waveform buffer with a buffer number of "1", makes a comparison as to whether the timbre number and the waveform number acquired from the above-described timbre selection processing and waveform information acquirement processing match those of the waveform information (Steps S1818 and S1820). When the timbre number and the waveform number both match those of the waveform information, the CPU 202 stops the above-described comparison processing, and copies and transfers the waveform data of the matched waveform buffer to the waveform buffer of the waveform reading device 304 that is a sound emission assignment target. That is, high-speed transfer from the RAM 208 to the RAM 208 is performed (Step S1822). The CPU 202 performs loop processing (Steps S1816 and S1824) of repeating the above-described series of processing operations (Steps S1818 to S1820) on each of the 256 waveform buffers.

In the above-described series of processing operations (Steps S1818 to S1820), when either one of the timbre number and the waveform number does not match a relevant one of the waveform information and both of the timbre number and the waveform number do not match those of the waveform information, the CPU 202 transfers the waveform data from the large-capacity flash memory 212 to the waveform buffer of the sound emission assignment target in the RAM 208 based on the waveform number, waveform size, and address information from the start of the waveform area acquired in the waveform information acquisition processing (Step S1826). With this waveform data transfer into the RAM 208 at Step S1822 and S1826 described above, the CPU 202 sets the timbre number, the timbre waveform number, and the waveform size to the timbre waveform directory (Step S1828).

Next, the CPU 202 confirms the waveform data transfer status, and judges whether the waveform data transfer has ended (Step S1830). When the waveform data is still being transferred, the CPU 202 maintains this state. When the waveform data transfer has ended, the CPU 202 sets the transfer flag at "1" (Step S1832), and starts a waveform reading operation from the start of the waveform buffer of the sound emission assignment target (Step S1834).

(MIDI Reception Processing)

Referring back to the main routine shown in FIG. 7, in the MIDI reception processing performed after the above-described keyboard processing (Step S710), the CPU 202 judges whether each received MIDI message includes a note-on event or a note-off event (Steps S722 and S726). When judged that a note-on event is included, the CPU 202 performs note-on processing (Step S724). When judged that a note-off event is included, the CPU 202 performs note-off processing (Step S728). Here, processing equivalent to the note-on processing (Step S1204) or the note-off processing (Step S1224) shown in FIG. 12A, FIG. 12B, FIG. 13A, and FIG. 13B is applied.

(Sound Source Periodical Processing)

Figure 19:
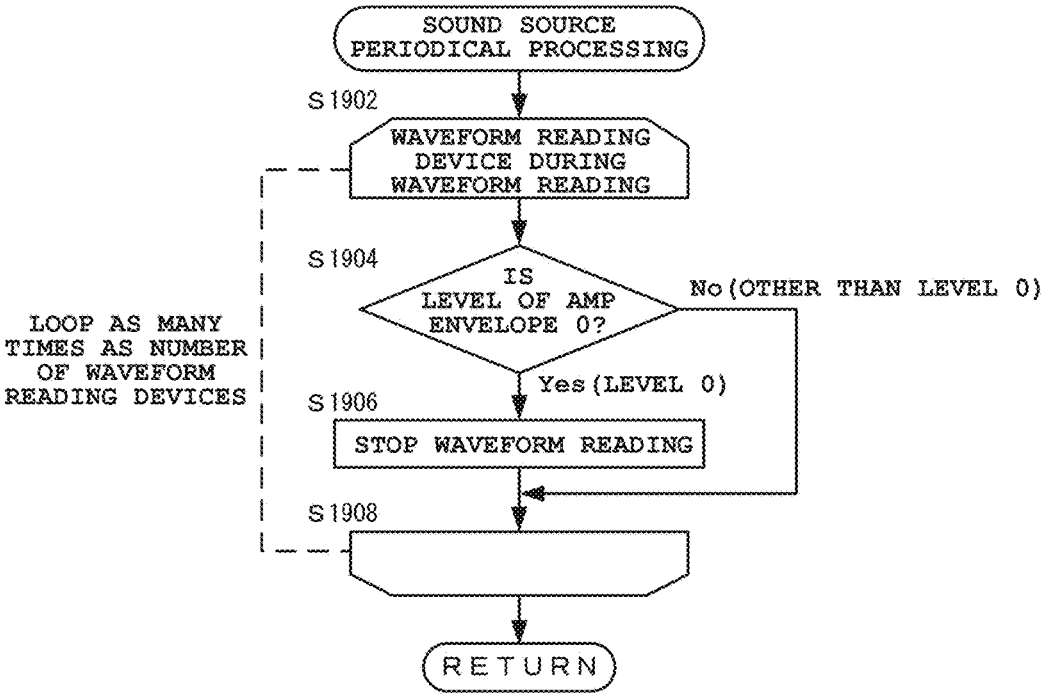
FIG. 19 is a flowchart of sound source periodical processing applied in the electronic keyboard instrument control method according to the present embodiment.

FIG. 19 is a flowchart of sound source periodical processing applied in the electronic keyboard instrument control method according to the present embodiment.

In the sound source periodical processing (Step S730) that is performed after the above-described MIDI reception processing (Step S720), the CPU 202 performs sound source processing at certain time intervals as shown in the flowchart in FIG. 19. Here, sequentially from the waveform reading device 304 with a number of "1", the CPU 202 confirms the status of the waveform reading device 304, and judges whether the level of the sound volume control (amp envelope) is "0" for each waveform reading device 304 reading waveform data (Step S1904). When the level of the sound volume control is "0", the CPU 202 stops the waveform reading operation of the waveform reading device 304. On the other hand, when the level of the sound volume control is not "0", the CPU 202 does not stop the waveform reading operation of the waveform reading device 304, and maintains the current state. The CPU 202 performs loop processing (Steps S1902 and S1908) of repeating the above-described series of processing operations (Steps S1904 to S1906) as many times as the number of waveform reading devices 304 reading waveform data.

As described above, in the present embodiment, the device includes a sound source memory constituted by the RAM 208 which is used by the sound source LSI 204 at the time of sound emission, and a large-capacity storage device constituted by the large-capacity flash memory 212 such as that of an NAND type which stores all pieces of waveform data to be used for timbre. Waveform data with a large data size which takes time to be transferred from the large-capacity storage device to the sound source memory is always arranged in the sound source memory, and waveform data with a relatively small data size is transferred at the time of sound emission from the large-capacity storage device to each waveform buffer of the sound source memory provided for each sound emission generator (waveform reading device 304) for sound emission. Here, in the sound source memory with a high access speed, waveform data having a data size exceeding a threshold set in advance is arranged. Waveform data having a data size equal to or smaller than the threshold is transferred at every sound emission from the large-capacity storage device with a low access speed to the sound source memory for use. As for this waveform data having a data size equal to or smaller than the threshold, prior to the above-described transfer processing from the large-capacity storage device, if waveform data as a sound emission target is not present in a waveform buffer (a first area) assigned to the generator that is a sound emission assignment target but is already present in a waveform buffer (a second area) assigned to another sound emission generator in the sound source memory, the waveform data is copied and transferred from that waveform buffer to the waveform buffer of the generator that is a sound emission assignment target and read out for sound emission.

As a result of this configuration, waveform data with a large data size can be directly read out from a sound source memory with a high access speed and waveform data with a small data size can be read out from an inexpensive large-capacity storage device or used in the sound source memory for use in musical sound generation processing, which effectively reduces the time required for musical sound generation processing using a plurality of waveform data and achieves a favorable musical performance with no delay or interruption in musical sound generation. This means that more pieces of timbre waveform data can be read out for simultaneous sound emission within a predetermined time required for musical sound generation processing, whereby an electronic instrument can be actualized which is capable of reproducing musical sounds having a higher degree of fidelity to the original sounds of wind instruments, stringed instruments, and the like.

In the above-described embodiment, as a method of using the waveform data in the RAM 208, prior to the processing of transferring the waveform data from the large-capacity flash memory 212 to the RAN 208, it is judged whether the waveform data as a sound emission target is already present in another waveform buffer in the RAM 208 and, if present, the waveform data of this other waveform buffer is copied and transferred to the waveform buffer of the sound emission assignment target, and then read out by the waveform reading device 304 of the sound source LSI 204 for use in sound emission. However, the present invention is not limited thereto. If the waveform data as a sound emission target is already present in another waveform buffer in the RAM 208, the waveform data of this waveform buffer may be directly read out by the waveform reading device 304 that is a sound emission assignment target so as to emit a sound. By this configuration as well, operations and effects equivalent to those of the above-described embodiment can be achieved.

Also, in the above-described embodiment, the processing of transferring waveform data having a data size exceeding a predetermined threshold value among the waveform data stored in the large-capacity flash memory 212 is performed at the start of the electronic keyboard instrument 100. However, the present invention is not limited thereto. That is, in the present invention, waveform data having a data size exceeding a predetermined threshold value may be stored in the RAM 208 at any timing before the start of musical performance of the electronic keyboard instrument 100. Therefore, for example, in a case where a non-volatile memory (such as a rewritable static RAM) is applied as the RAM 208, waveform data having a data size exceeding a predetermined threshold value may be stored in the RAM 208 at the time of factory shipping or may be transferred from the large-capacity flash memory 212 to the RAM 208 only once at the time of the purchase of the product.

Modification Example

Figure 20:
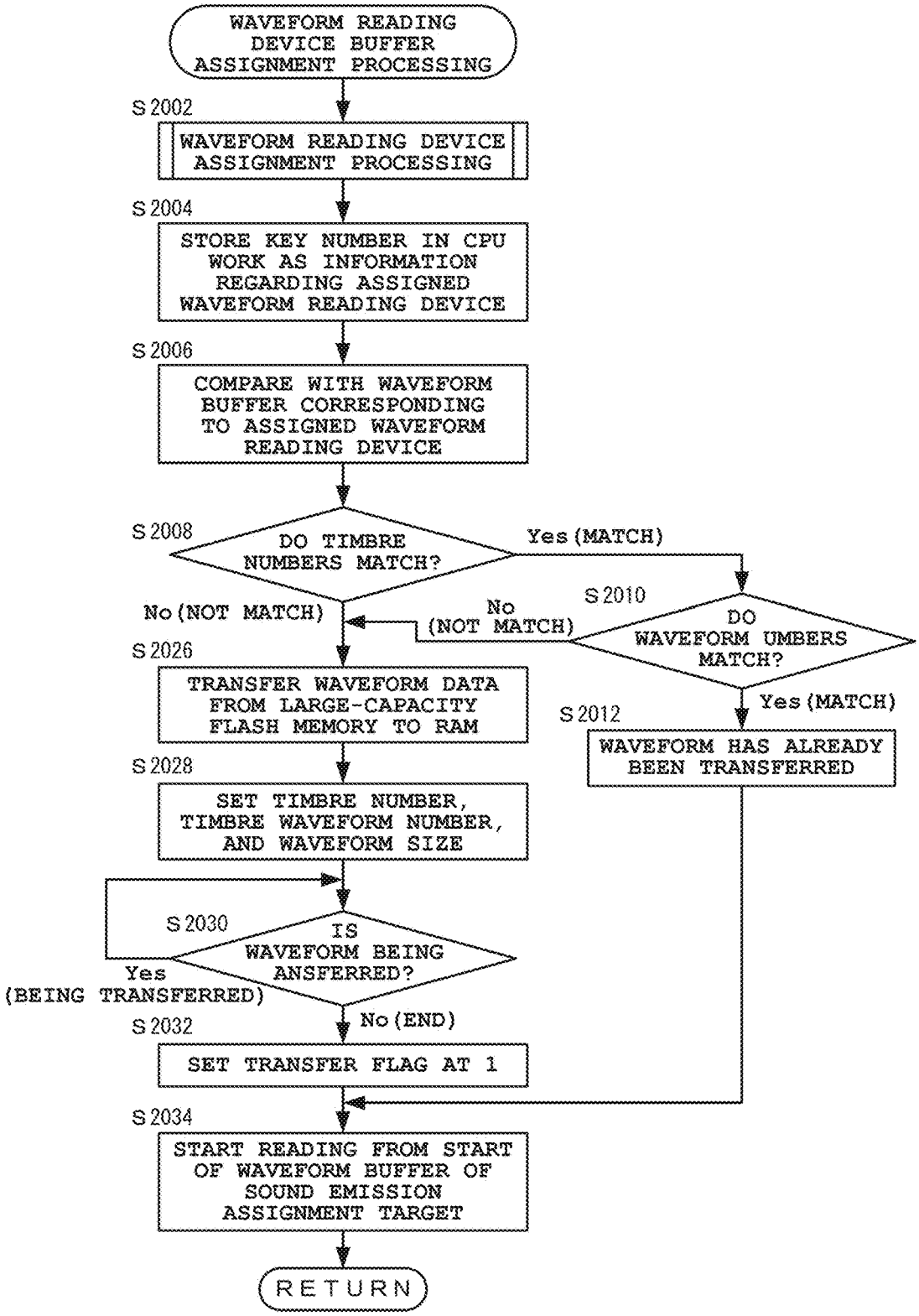
FIG. 20 is a flowchart of waveform reading device buffer assignment processing applied in note-on processing of an electronic keyboard instrument control method according to a modification example of the present embodiment.

FIG. 20 is a flowchart of waveform reading device buffer assignment processing applied in note-on processing of an electronic keyboard instrument control method according to a modification example of the present embodiment. Here, processing operations equivalent to those of the above-described embodiment (FIG. 18) are provided with the same reference numerals and not described.

In the above-described embodiment, the waveform data using method has been described in which, prior to the processing of transferring waveform data from the large-capacity flash memory 212 to the RAM 208, it is judged whether the waveform data as a sound emission target is already present in another waveform buffer of the RAM 208 and, if present, the waveform data of that waveform buffer is copied and transferred.

In the present embodiment, a modification example may be adopted in which the above-described method of using waveform data in the RAM (corresponding to Steps S1814 to S1824 shown in FIG. 18) is not applied, as shown in the flowchart of FIG. 20.

More specifically, in the present modification example, as with the waveform reading device assignment processing described in the above-described embodiment (refer to FIG. 18), the CPU 202 makes a comparison as to whether the timbre number and waveform number acquired in the above-described timbre selection processing and waveform information acquisition processing match those of information regarding the waveform buffer corresponding to the assigned waveform reading device 304 (Steps S2006 to S2010). When the acquired timbre number and waveform number both match those of the information, the CPU 202 judges that the waveform data has already been transferred (Step S2012), and starts a waveform reading operation from the start of the waveform buffer of the sound emission assignment target (Step S2034).

On the other hand, in the above-described comparison processing, when either one of the timbre number and the waveform number does not match one of the information, the CPU 202 transfers the waveform data from the large-capacity flash memory 212 to the waveform buffer of the sound emission assignment target in the RAM 208 based on the waveform number, the waveform size, and the address information from the start of the waveform area acquired in the waveform information acquisition processing (Step S2026). Thereafter, the CPU 202 performs processing operations similar to those of the waveform reading device buffer assignment processing described in the above-described embodiment to start a waveform reading operation from the start of the waveform buffer of the sound emission assignment target (Steps S2028 to S2034).

In this modification example as well, the time required for musical sound generation processing using a plurality of waveform data can be effectively reduced and a favorable musical performance can be achieved with no delay or interruption in musical sound generation, as with the above-described embodiment.

Furthermore, in the above-described embodiment, a control section which performs various control operations is constituted by a CPU (general-purpose processor) executing a program stored in a ROM (memory). However, the plurality of control operations may be performed by a plurality of dedicated processors, respectively. In this structure, each dedicated processor may be constituted by a general-purpose processor (electronic circuit) that can execute any program and a memory having stored therein a control program tailored to each control, or may be constituted by a dedicated electronic circuit tailored to each control.

Also, the processing of the sound source LSI may be performed by a DSP (Digital Signal Processor) or CPU.

Furthermore, devices for acquiring the above-described various effects are not necessarily required to be structured as described above, and may be structured as follows.

Structural Example 1

A structure including:

a first memory having a plurality of waveform data stored therein;

a second memory which stores waveform data read out from the first memory in a manner that the waveform data is readable for sound emission by a sound source processor; and a control processor which controls such that, when an instruction for sound emission is provided and waveform data specified in association with the sound emission is in the second memory, the specified waveform data stored in the second memory is read out by the sound source processor, or controls such that, when an instruction for sound emission is provided and waveform data specified in association with the sound emission is not in the second memory, the specified waveform data is transferred from the first memory to the second memory and the transferred waveform data in the second memory is read out by the sound source processor, in which the control processor controls such that, among a plurality of waveform data stored in the second memory, waveform data satisfying a set condition is not subjected to a waveform data change by the transfer, and waveform data not satisfying the set condition is subjected to the waveform data change by the transfer.

Structural Example 2

The structure of Structural Example 1, in which the control processor transfers in advance the waveform data satisfying the set condition among the plurality of waveform data from the first memory to the second memory, and stores the waveform data in the second memory in a manner that the waveform data is not subjected to the waveform data change by the transfer.

Structural Example 3

The structure of Structural Example 1, in which the control processor stores, among the plurality of waveform data, waveform data having a data size exceeding a predetermined threshold value fixedly in the second memory in a manner that the waveform data is not changed during a musical performance including the sound emission.

Structural Example 4

The structure of Structural Example 3, in which the predetermined threshold value is set based on a waveform data size by which a delay time until the sound emission in the musical performance is equal to or shorter than a predetermined time.

Structural Example 5

The structure of Structural Example 1, in which the sound source processor is plurally provided, and in which the control processor (i) divides the second memory into a plurality of areas and assigns the plurality of areas as areas from which the plurality of sound source processors read out waveform data, (ii) specifies a first sound source processor for which the specified waveform data is read out for sound emission, from among the plurality of sound source processors, and (iii) transfers, when the specified waveform data has not been stored in a first area of the second memory assigned to the first sound source processor and has been stored in a second area of the second memory, the waveform data stored in the second area to the first area and then reads out the waveform data for sound emission.

Structural Example 6

The structure of Structural Example 1, in which the sound source processor is plurally provided, and in which the control processor (i) divides the second memory into a plurality of areas and assigns the plurality of areas as areas from which the plurality of sound source processors read out waveform data, (ii) specifies a first sound source processor which reads out the specified waveform data for sound emission, from among the plurality of sound source processors, and (iii) controls such that, when the specified waveform data has not been stored in a first area of the second memory assigned to the first sound source processor and has been stored in a second area of the second memory assigned to a second sound source processor different form the first sound source processor, the first sound source processor directly reads out the waveform data stored in the second area for sound emission.

Structural Example 7

The structure of Structural Example 1, in which the first memory is a storage device with a first read speed and a first storage capacity, and in which the second memory is a storage device with a second read speed higher than the first read speed and a second storage capacity smaller than the first storage capacity.

Structural Example 8

The structure of Structural Example 7, in which the second memory has a first memory area where the waveform data satisfying the set condition is fixedly stored prior to start of a musical performance including the sound emission and a second memory area where waveform data specified during the musical performance and transferred from the first memory is variably stored.

While the present invention has been described with reference to the preferred embodiments, it is intended that the invention be not limited by any of the details of the description therein but includes all the embodiments which fall within the scope of the appended claims.

What is claimed is:

1. A musical sound generation device comprising a first memory having a plurality of waveform data stored therein;

a second memory which stores waveform data read out from the first memory in a manner that the waveform data is readable for sound emission by a sound source processor; and a control processor which controls such that, when an instruction for sound emission is provided and waveform data specified in association with the sound emission is in the second memory, the specified waveform data stored in the second memory is read out by the sound source processor, or controls such that, when an instruction for sound emission is provided and waveform data specified in association with the sound emission is not in the second memory, the specified waveform data is transferred from the first memory to the second memory and the transferred waveform data in the second memory is read out by the sound source processor, wherein the control processor controls such that, among a plurality of waveform data stored in the second memory, wavefoim data satisfying a set condition is not subjected to a waveform data change by the transfer, and waveform data not satisfying the set condition is subjected to the waveform data change by the transfer.

2. The musical sound generation device according to claim 1, wherein the control processor transfers in advance the waveform data satisfying the set condition among the plurality of waveform data from the first memory to the second memory, and stores the waveform data in the second memory in a manner that the waveform data is not subjected to the waveform data change by the transfer.

3. The musical sound generation device according to claim 1, wherein the control processor stores, among the plurality of waveform data, waveform data having a data size exceeding a predetermined threshold value fixedly in the second memory in a manner that the waveform data is not changed during a musical performance including the sound emission.

4. The musical sound generation device according to claim 3, wherein the predetermined threshold value is set based on a waveform data size by which a delay time until the sound emission in the musical performance is equal to or shorter than a predetermined time.

5. The musical sound generation device according to claim 1, wherein the sound source processor is plurally provided, and wherein the control processor (i) divides the second memory into a plurality of areas and assigns the plurality of areas, as areas from which the plurality of sound source processors read out waveform data, (ii) specifies a first sound source processor for which the specified waveform data is read out for sound emission, from among the plurality of sound source processors, and (iii) transfers, when the specified waveform data has not been stored in a first area of the second memory assigned to the first sound source processor and has been stored in a second area of the second memory, the waveform data stored in the second area to the first area and then reads out the waveform data for sound emission.

6. The musical sound generation device according to claim 1, wherein the sound source processor is plurally provided, and wherein the control processor (i) divides the second memory into a plurality of areas and assigns the plurality of areas as areas from which the plurality of sound source processors read out waveform data, (ii) specifies a first sound source processor which reads out the specified waveform data for sound emission, from among the plurality of sound source processors, and (iii) controls such that when the specified waveform data has not been stored in a first area of the second memory assigned to the first sound source processor and has been stored in a second area of the second memory assigned to a second sound source processor different form the first sound source processor, the first sound source processor directly reads out the waveform data stored in the second area for sound emission.

7. The musical sound generation device according to claim 1, wherein the first memory is a storage device with a first read speed and a first storage capacity, and wherein the second memory is a storage device with a second read speed higher than the first read speed and a second storage capacity smaller than the first storage capacity.

8. The musical sound generation device according to claim 7, wherein the second memory has a first memory area where the waveform data satisfying the set condition is fixedly stored prior to start of a musical performance including the sound emission and a second memory area where waveform data specified during the musical performance and transferred from the first memory is variably stored.

9. A musical sound generation method, wherein a control processor of a musical sound generation device (i) causes waveform data read out from a first memory having a plurality of waveform data to be stored in a second memory in a manner to be readable for sound emission by a sound source processor, (ii) causes waveform data satisfying a set condition among the plurality of waveform data to be stored in the second memory in advance in a manner not to be changed by transfer, (iii) causes, when an instruction for sound emission is provided and specified waveform data is not in the second memory, the specified waveform data to be transferred from the first memory to the second memory and then causes the transferred waveform data in the second memory to be read out by the sound source processor, and (iv) controls such that, among a plurality of waveform data stored in the second memory, waveform data satisfying a set condition is not subjected to a waveform data change by the transfer, and waveform data not satisfying the set condition is subjected to the waveform data change by the transfer.

10. The musical sound generation method according to claim 9, wherein the control processor transfers in advance the waveform data satisfying the set condition among the plurality of waveform data from the first memory to the second memory, and stores the waveform data in the second memory in a manner that the waveform data is not subjected to the waveform data change by the transfer.

11. The musical sound generation method according to claim 9, wherein the control processor stores, among the plurality of waveform data, waveform data having a data size exceeding a predetermined threshold value fixedly in the second memory in a manner that the waveform data is not changed during a musical performance including the sound emission.

12. The musical sound generation method according to claim 11, wherein the predetermined threshold value is set based on a waveform data size by which a delay time until the sound emission in the musical performance is equal to or shorter than a predetermined time.

13. A non-transitory computer-readable storage medium having stored thereon a program that is executable by a computer to function as the musical sound generation device according to claim 1.

14. An electronic instrument comprising:

the musical sound generation device according to claim 1;

an input section which specifies the waveform data by a musical performance including the sound emission; and an output section which outputs an emitted musical sound.

* * * * *

UNITED STATES PATENT AND TRADEMARK OFFICE

CERTIFICATE OF CORRECTION

PATENT NO. : 10,373,595 B2
APPLICATION NO. : 15/910901
DATED : August 6, 2019
INVENTOR(S) : Hiroki Sato and Hajime Kawashima It is certified that error appears in the above-identified patent and that said Letters Patent is hereby corrected as shown below:

In the Claims

Column 24, Line 6, Claim 1, Line 1, after "comprising" insert -- : --.

Column 24, Line 28, Claim 1, Line 23, delete "wavefoim" and insert -- waveform --.

Column 24, Line 56, Claim 5, Line 6, delete "areas," and insert -- areas --.

Column 25, Line 11, Claim 6, Line 11, after "that" insert -- , --.

Column 25, Line 16, Claim 6, Line 16, delete "form" and insert -- from --.

Signed and Sealed this
Nineteenth Day of November, 2019

Andrei Iancu

Andrei Iancu
*Director of the United States Patent and Trademark Office*